US012091793B2

(12) United States Patent
Xu

(10) Patent No.: US 12,091,793 B2
(45) Date of Patent: Sep. 17, 2024

(54) METHODS FOR THROUGH-FLUID BONDING NONWOVEN WEBS

(71) Applicant: The Procter & Gamble Company, Cincinnati, OH (US)

(72) Inventor: Han Xu, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 10 days.

(21) Appl. No.: 18/095,066

(22) Filed: Jan. 10, 2023

(65) Prior Publication Data

US 2023/0160117 A1 May 25, 2023

Related U.S. Application Data

(63) Continuation of application No. 16/695,441, filed on Nov. 26, 2019, now abandoned, which is a (Continued)

(51) Int. Cl.
*D04H 3/14* (2012.01)
*D04H 1/54* (2012.01)
(Continued)

(52) U.S. Cl.
CPC ..... *D04H 3/16* (2013.01); *D04H 1/54* (2013.01); *D04H 3/14* (2013.01); *D04H 13/007* (2013.01)

(58) Field of Classification Search
CPC ..... D04H 1/54; D04H 1/541; D04H 1/5412; D04H 1/5414; D04H 1/558; D04H 3/007;
(Continued)

(56) References Cited

U.S. PATENT DOCUMENTS 3,616,031 A 10/1971 Fleissner
4,089,720 A 5/1978 Haley
(Continued)

FOREIGN PATENT DOCUMENTS

CA 2378912 A1 2/2001
CN 1085972 A 4/1994
(Continued)

OTHER PUBLICATIONS

All Office Actions; U.S. Appl. No. 18/449,737, filed Aug. 15, 2023.
(Continued)

*Primary Examiner* — Michael A Tolin
(74) *Attorney, Agent, or Firm* — Daniel S. Albrecht

(57) ABSTRACT

Methods for manufacturing through-fluid bonded continuous fiber nonwoven webs are provided. The method may include providing a through-fluid bonding oven. The through-fluid bonding oven may have a first porous member and a second moving member. An intermediate continuous fiber nonwoven web may be conveyed into the through-fluid bonding oven intermediate the first and second moving porous members. A first surface of the intermediate continuous fiber nonwoven web may be in face-to-face contact with the first porous member. A second surface of the intermediate continuous fiber nonwoven web may be in face-to-face contact with the second porous member. A heated fluid may be flowed through the first and second porous members and the intermediate continuous fiber nonwoven web to create a continuous fiber nonwoven web.

14 Claims, 6 Drawing Sheets

Related U.S. Application Data continuation of application No. PCT/CN2018/118636, filed on Nov. 30, 2018.

(51) Int. Cl.
*D04H 3/16* (2006.01)
*D04H 13/00* (2006.01)

(58) Field of Classification Search
CPC ..... D04H 3/011; D04H 3/018; D04H 3/10; D04H 3/105; D04H 3/11; D04H 3/14; D04H 3/147; D04H 3/16; D04H 13/007
See application file for complete search history.

(56) References Cited

U.S. PATENT DOCUMENTS 4,097,965 A 7/1978 Gotchel et al.
4,107,364 A 8/1978 Sisson
4,940,502 A 7/1990 Marcus
5,302,220 A 4/1994 Terakawa et al.
5,382,400 A 1/1995 Pike et al.
5,522,810 A 6/1996 Allen, Jr. et al.
5,540,979 A 7/1996 Yahiaoui et al.
5,575,874 A 11/1996 Griesbach, III
5,599,420 A 2/1997 Yeo
5,622,772 A 4/1997 Stokes et al.
5,672,415 A 9/1997 Sawyer et al.
5,874,159 A 2/1999 Cruise et al.
6,066,221 A 5/2000 Marmon et al.
6,319,455 B1 11/2001 Kauschke et al.
6,391,443 B1 5/2002 Terada et al.
6,454,989 B1 9/2002 Neely et al.
6,478,786 B1 11/2002 Glaug et al.
6,491,933 B2 12/2002 Lorenzi et al.
6,509,513 B2 1/2003 Glaug et al.
6,528,439 B1 3/2003 Stokes et al.
H2062 H 4/2003 Blaney et al.
6,576,575 B2 6/2003 Griesbach, III
6,588,080 B1 7/2003 Neely et al.
6,589,892 B1 7/2003 Smith et al.
6,592,697 B2 7/2003 Pike et al.
6,592,960 B1 7/2003 Suzuki et al.
6,613,704 B1 9/2003 Arnold et al.
6,627,025 B1 9/2003 Yu
6,642,429 B1 11/2003 Carter et al.
6,686,303 B1 2/2004 Haynes et al.
6,736,916 B2 5/2004 Steinke et al.
6,740,792 B2 5/2004 Waldroup et al.
6,777,056 B1 8/2004 Boggs et al.
6,781,027 B2 8/2004 Fenwick et al.
6,783,837 B1 8/2004 Creagan et al.
6,797,360 B2 9/2004 Varona
6,867,156 B1 3/2005 White et al.
6,869,670 B2 3/2005 Delucia et al.
6,877,246 B1 4/2005 Hada et al.
6,878,650 B2 4/2005 Clark et al.
6,887,423 B2 5/2005 Van Trump et al.
6,911,174 B2 6/2005 Creagan
6,946,506 B2 9/2005 Bond
6,989,125 B2 1/2006 Boney et al.
6,998,164 B2 2/2006 Neely et al.
7,004,738 B2 2/2006 Becker et al.
7,018,945 B2 3/2006 Yahiaoui et al.
7,045,211 B2 5/2006 Fairbanks et al.
7,056,891 B2 6/2006 Resheski-wedepohl et al.
7,172,801 B2 2/2007 Hoying et al.
7,179,247 B2 2/2007 Mizutani et al.
7,196,026 B2 3/2007 Di Luccio
7,247,215 B2 7/2007 Schewe
7,291,239 B2 11/2007 Polanco et al.
7,309,522 B2 12/2007 Webb et al.
7,413,803 B2 8/2008 Jordan et al.
7,425,517 B2 9/2008 Deka et al.
7,651,653 B2 1/2010 Morman et al.
7,674,058 B2 3/2010 Berger et al.
7,922,849 B2 4/2011 Sommer et al.
7,943,813 B2 5/2011 Petryk et al.
7,989,062 B2 8/2011 Chakravarty et al.
7,998,384 B2 8/2011 Gillespie et al.
8,093,161 B2 1/2012 Bansal
8,148,279 B2 4/2012 Anantharamaiah et al.
8,236,385 B2 8/2012 Yahiaoui et al.
8,240,484 B2 8/2012 Fox et al.
8,314,286 B2 11/2012 Drzewiecki et al.
8,410,005 B2 4/2013 Brennan et al.
8,420,557 B2 4/2013 Haberer et al.
8,426,671 B2 4/2013 Steffen et al.
8,440,123 B2 5/2013 Hanson et al.
8,440,286 B2 5/2013 Curro et al.
8,518,311 B2 8/2013 He et al.
8,569,569 B2 10/2013 Zhang et al.
8,669,410 B2 3/2014 Weismantel et al.
8,710,293 B2 4/2014 Zhang et al.
8,721,827 B2 5/2014 Chang et al.
8,895,800 B2 11/2014 Weismantel et al.
8,906,815 B2 12/2014 Moore et al.
8,932,704 B2 1/2015 Porbeni et al.
9,029,277 B2 5/2015 Ngai
9,073,040 B2 7/2015 Dobrawa et al.
9,089,624 B2 7/2015 Whitmore et al.
9,163,336 B2 10/2015 He et al.
9,194,065 B2 11/2015 Moore et al.
9,237,973 B2 1/2016 Abuto et al.
9,259,059 B2 2/2016 Horn et al.
9,416,485 B2 8/2016 Moore et al.
9,480,968 B2 11/2016 Weismantel et al.
9,539,357 B2 1/2017 Ashraf et al.
9,540,746 B2 1/2017 Ashraf et al.
11,236,448 B2 2/2022 Brennan et al.
11,396,720 B2 7/2022 Xu et al.
2001/0041876 A1 11/2001 Creagan et al.
2002/0019206 A1 2/2002 Deka et al.
2002/0090499 A1 7/2002 Shelley et al.
2002/0177829 A1 11/2002 Fell
2003/0027977 A1 2/2003 Koning et al.
2003/0045192 A1 3/2003 Midkiff et al.
2003/0056883 A1 3/2003 Bansal et al.
2003/0068947 A1 4/2003 Marmon et al.
2003/0082340 A1 5/2003 Mccabe et al.
2003/0082977 A1 5/2003 Kuroiwa et al.
2003/0087574 A1 5/2003 Latimer et al.
2003/0104748 A1 6/2003 Brown et al.
2003/0114066 A1 6/2003 Clark et al.
2003/0116259 A1 6/2003 Sayovitz et al.
2003/0118816 A1 6/2003 Polanco et al.
2003/0203162 A1 10/2003 Fenwick
2003/0213109 A1 11/2003 Neely et al.
2004/0005457 A1 1/2004 Delucia et al.
2004/0038612 A1 2/2004 Forbes et al.
2004/0110442 A1 6/2004 Rhim
2004/0116018 A1 6/2004 Fenwick et al.
2004/0121680 A1 6/2004 Yahiaoui et al.
2004/0122396 A1 6/2004 Maldonado et al.
2004/0170836 A1 9/2004 Bond
2004/0201125 A1 10/2004 Allen et al.
2004/0224136 A1 11/2004 Collier et al.
2004/0236297 A1 11/2004 Drzewiecki et al.
2004/0254555 A1 12/2004 Wang et al.
2005/0020170 A1 1/2005 Deka et al.
2005/0077646 A1 4/2005 Akiba et al.
2005/0079785 A1 4/2005 Bond
2005/0087288 A1 4/2005 Haynes et al.
2005/0095943 A1 5/2005 Griffin et al.
2005/0104261 A1 5/2005 Allen et al.
2005/0118916 A1 6/2005 Ducker et al.
2005/0136242 A1 6/2005 Yahiaoui et al.
2005/0136773 A1 6/2005 Yahiaoui
2005/0197027 A1 9/2005 Crane et al.
2005/0227563 A1 10/2005 Bond
2005/0244619 A1 11/2005 Kauschke et al.
2005/0245157 A1 11/2005 Kepner et al.
2005/0245158 A1 11/2005 Yahiaoui et al.
2005/0245162 A1 11/2005 Ng et al.
2005/0256476 A1 11/2005 Mirle et al.

(56) References Cited

U.S. PATENT DOCUMENTS

| | | | |
|---|---|---|---|
| 2005/0260914 | A1 | 11/2005 | Oathout |
| 2006/0004334 | A1 | 1/2006 | Schlinz et al. |
| 2006/0027944 | A1 | 2/2006 | Bentley et al. |
| 2006/0141217 | A1 | 6/2006 | Ellis et al. |
| 2007/0026753 | A1 | 2/2007 | Neely |
| 2007/0098768 | A1 | 5/2007 | Close et al. |
| 2007/0141303 | A1 | 6/2007 | Steindorf |
| 2008/0000057 | A1 | 1/2008 | Nguyen |
| 2008/0003906 | A1 | 1/2008 | Hill et al. |
| 2008/0038976 | A1 | 2/2008 | Berrigan et al. |
| 2008/0086105 | A1 | 4/2008 | Sour |
| 2008/0118727 | A1 | 5/2008 | Andersen |
| 2008/0210363 | A1 | 9/2008 | Sommer et al. |
| 2009/0076472 | A1 | 3/2009 | Goldwasser et al. |
| 2009/0142595 | A1 | 6/2009 | Matsui et al. |
| 2010/0159770 | A1 | 6/2010 | Walser et al. |
| 2010/0174260 | A1 | 7/2010 | Di Luccio et al. |
| 2010/0310845 | A1 | 12/2010 | Bond et al. |
| 2010/0323575 | A1 | 12/2010 | He et al. |
| 2011/0003524 | A1 | 1/2011 | Claasen et al. |
| 2011/0076907 | A1 | 3/2011 | Glew et al. |
| 2011/0123802 | A1 | 5/2011 | Chang et al. |
| 2011/0144608 | A1 | 6/2011 | Kim et al. |
| 2011/0179558 | A1 | 7/2011 | Lyons |
| 2011/0250378 | A1 | 10/2011 | Eaton |
| 2012/0004632 | A1 | 1/2012 | Zhang et al. |
| 2012/0040185 | A1 | 2/2012 | Topolkaraev et al. |
| 2013/0004552 | A1 | 1/2013 | Pedoja |
| 2013/0023608 | A1 | 1/2013 | Kellett et al. |
| 2013/0053479 | A1 | 2/2013 | Bond et al. |
| 2013/0096526 | A1 | 4/2013 | Schroeder et al. |
| 2013/0108831 | A1 | 5/2013 | Wu et al. |
| 2013/0210308 | A1 | 8/2013 | Mceneany et al. |
| 2013/0309932 | A1 | 11/2013 | He et al. |
| 2014/0138584 | A1 | 5/2014 | Bond et al. |
| 2014/0142225 | A1 | 5/2014 | Bond et al. |
| 2014/0142226 | A1 | 5/2014 | Bond et al. |
| 2014/0142232 | A1 | 5/2014 | Bond et al. |
| 2014/0142233 | A1 | 5/2014 | Layman et al. |
| 2014/0145374 | A1 | 5/2014 | Altonen et al. |
| 2014/0272362 | A1 | 9/2014 | Dugan et al. |
| 2014/0296388 | A1 | 10/2014 | Bond et al. |
| 2014/0378922 | A1 | 12/2014 | Fuchs et al. |
| 2015/0004866 | A1 | 1/2015 | Scholz et al. |
| 2015/0017411 | A1 | 1/2015 | Wilkie et al. |
| 2015/0137413 | A1 | 5/2015 | Bond et al. |
| 2015/0173975 | A1 | 6/2015 | Harumoto et al. |
| 2015/0211157 | A1 | 7/2015 | Okuda et al. |
| 2015/0211158 | A1 | 7/2015 | Hassan et al. |
| 2015/0322601 | A1 | 11/2015 | Brown et al. |
| 2016/0040337 | A1 | 2/2016 | Dutkiewicz et al. |
| 2016/0101208 | A1 | 4/2016 | Topolkaraev et al. |
| 2016/0151213 | A1 | 6/2016 | Bauduin et al. |
| 2016/0206772 | A1 | 7/2016 | Schröder et al. |
| 2016/0206984 | A1 | 7/2016 | Berrigan et al. |
| 2016/0222558 | A1 | 8/2016 | Hofemeister et al. |
| 2016/0251788 | A1 | 9/2016 | Huang et al. |
| 2016/0263271 | A1 | 9/2016 | Huang et al. |
| 2017/0144405 | A1 | 5/2017 | Liu et al. |
| 2017/0211216 | A1 | 7/2017 | Brown et al. |
| 2017/0314163 | A1 | 11/2017 | Sommer et al. |
| 2018/0002850 | A1 | 1/2018 | Hansen et al. |
| 2018/0044826 | A1 | 2/2018 | Maschino et al. |
| 2019/0316284 | A1 | 10/2019 | Hansen et al. |
| 2020/0170853 | A1 | 6/2020 | Brennan et al. |
| 2020/0173077 | A1 | 6/2020 | Brennan et al. |
| 2020/0173078 | A1 | 6/2020 | Xu |
| 2021/0214870 | A1 | 7/2021 | Cinquemani et al. |
| 2022/0098771 | A1 | 3/2022 | Brennan et al. |
| 2022/0298687 | A1 | 9/2022 | Xu et al. |

FOREIGN PATENT DOCUMENTS

| | | | |
|---|---|---|---|
| CN | 1131214 | A | 9/1996 |
| CN | 1207667 | A | 2/1999 |
| CN | 1207779 | A | 2/1999 |
| CN | 1331766 | A | 1/2002 |
| CN | 1582224 | A | 2/2005 |
| CN | 1934296 | A | 3/2007 |
| CN | 1993505 | A | 7/2007 |
| CN | 201321535 | Y | 10/2009 |
| CN | 101956295 | A | 1/2011 |
| CN | 101990586 | A | 3/2011 |
| CN | 102482819 | A | 5/2012 |
| CN | 104711764 | | 6/2015 |
| CN | 105463699 | B | 4/2016 |
| CN | 106795670 | A | 5/2017 |
| CN | 107227559 | A | 10/2017 |
| CN | 107326541 | A | 11/2017 |
| CN | 207175103 | U | 4/2018 |
| CN | 108349222 | A | 7/2018 |
| DE | 102011050328 | B3 | 6/2012 |
| EP | 0665315 | A1 | 8/1995 |
| JP | H07216710 | A | 8/1995 |
| JP | H10280267 | A | 10/1998 |
| JP | 2004511670 | A | 4/2004 |
| JP | 2010156076 | A | 7/2010 |
| WO | 9721863 | | 6/1997 |
| WO | 0112888 | A1 | 2/2001 |
| WO | 0174281 | A1 | 10/2001 |
| WO | 2005001188 | A1 | 1/2005 |
| WO | 2008087193 | A2 | 7/2008 |

OTHER PUBLICATIONS

Unpublished U.S. Appl. No. 18/449,737, filed Aug. 15, 2023 to Han Xu et al.

15412F PCT Supplementary International Search Report for PCT/CN2018/118636 dated Mar. 17, 2021, 7 pages.

All Office Actions; U.S. Appl. No. 16/695,248, filed Nov. 26, 2019.

All Office Actions; U.S. Appl. No. 16/695,441, filed Nov. 26, 2019.

All Office Actions; U.S. Appl. No. 17/830,416, filed Jun. 2, 2022.

15412F PCT Search Report and Written Opinion for PCT/CN2018/118636 dated Aug. 28, 2019, 11 pages.

Jin Xiangyu "Collection of Essays of Research on Nonwoven Technology", China Textile University, 1st volume, Feb. 1997, pp. 137-141.

15412D EPO Search Report and Opinion for 23215719.8 dated Mar. 4, 2024, 8 pages.

METHODS FOR THROUGH-FLUID BONDING NONWOVEN WEBS

CROSS REFERENCE TO RELATED APPLICATION

This application is a continuation of, and claims priority under 35 U.S.C. § 120 to, U.S. patent application Ser. No. 16/695,441, filed on Nov. 26, 2019, which is a continuation of International Patent Application No. PCT/CN2018/118636, filed on Nov. 30, 2018, the entire disclosure of both of which are hereby incorporated by reference herein.

FIELD

The present disclosure is generally directed to methods for through-fluid bonding nonwoven webs, and is more particularly directed to methods for through-fluid bonding continuous fiber nonwoven webs.

BACKGROUND

Nonwoven webs may comprise continuous fibers. The continuous fibers may be manufactured by a continuous fiber nonwoven manufacturing operation. The continuous fibers may comprise multi-constituent fibers, such as bi-component fibers, for example. In such an operation, continuous fiber strands of molten polymer may be drawn or pushed downwardly from a spinneret by a fluid, such as air, toward a moving porous member, such as a moving porous belt. During the drawing, the continuous fiber strands may be quenched and stretched. Once the continuous fibers are deposited onto the moving porous member they may be formed into an intermediate continuous fiber nonwoven web and may be conveyed downstream for final bonding to create a continuous fiber nonwoven web. An "intermediate continuous fiber nonwoven web" as used herein means a web that has not yet been finally bonded. The intermediate continuous fiber nonwoven web may be through-fluid bonded in a through-fluid bonding oven. Conventional through-fluid bonding and ovens, however, tend to reduce loft and softness in the intermediate continuous fiber nonwoven web. Further, typically the final continuous fiber nonwoven webs experience sidedness (i.e., one surface is bonded more than the other). To achieve better loft and softness, through-fluid bonding ovens and methods of through-fluid bonding should be improved.

SUMMARY

Aspects of the present disclosure solve the problem of reduced loft and softness in a through-fluid bonding process/oven. This may be accomplished by conveying a low density, intermittently pre-bonded, intermediate continuous fiber nonwoven web into and through a through-fluid bonding oven. This may also be accomplished by re-lofting the intermediate continuous fiber nonwoven web prior to entry into the through-fluid bonding oven. This may also be accomplished by conveying the intermediate continuous fiber nonwoven web through the through-fluid bonding oven intermediate two moving porous members so that the web is conveyed under shear. This allows the web to relax in the machine direction, even to a negative machine direction strain, to allow the web to remain soft and lofty while being conveyed through the through-fluid bonding oven.

Aspects of the present disclosure also solve the problem of sidedness so that fairly uniform through-fluid bonding may be achieved on both surfaces of the intermediate continuous fiber nonwoven web. Sidedness may be reduced by flipping the web over in a through-fluid bonding oven so that both sides receive the same conductive heat transfer from a moving porous member within the oven. This is contrasted to conventional though-fluid bonding ovens where one side of the web would receive conductive heat transfer from a moving porous member and the other side of the web would receive convective heat transfer from the fluid flowing through the oven. Sidedness may also be reduced, without flipping the web, by flowing a first heated fluid a first direction in a first zone of a through-fluid bonding oven or oven and flowing a second heated fluid in a second direction in a second zone of a through-fluid bonding oven or oven, wherein the second zone is positioned downstream or upstream of the first zone. In this fashion, both surfaces of the web would be forced against a moving porous member and thereby conductive heat transfer will occur on both surfaces.

BRIEF DESCRIPTION OF THE DRAWINGS

The above-mentioned and other features and advantages of the present disclosure, and the manner of attaining them, will become more apparent and the disclosure itself will be better understood by reference to the following description of example forms of the disclosure taken in conjunction with the accompanying drawings, wherein.

DETAILED DESCRIPTION

Figure 1:
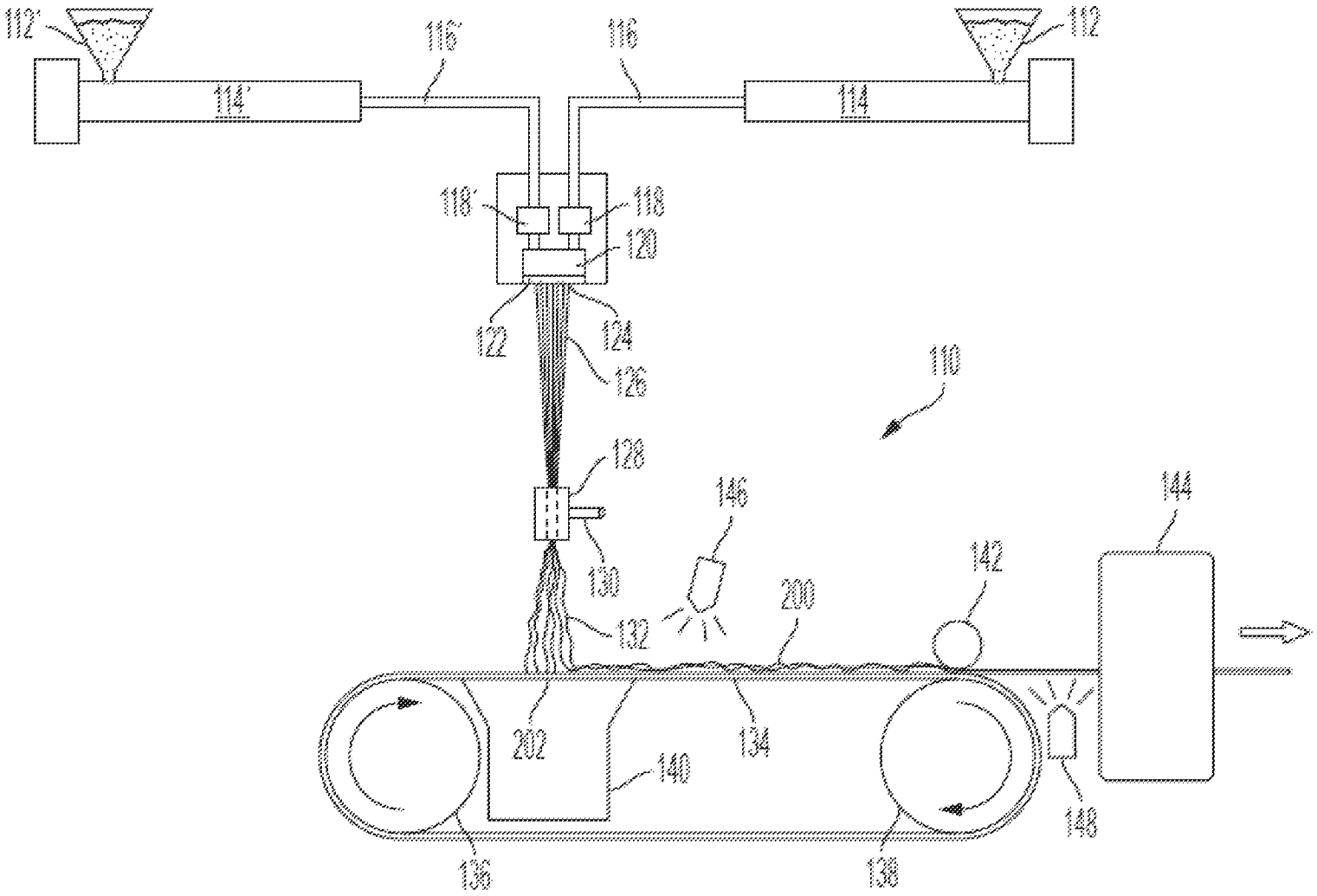
FIG. 1 is a diagrammatic view of an apparatus for performing a process for forming a continuous fiber nonwoven web.

Various non-limiting forms of the present disclosure will now be described to provide an overall understanding of the principles of the structure, function, manufacture, and use of the methods of through-fluid bonding nonwoven webs disclosed herein. One or more examples of these non-limiting forms are illustrated in the accompanying drawings. Those of ordinary skill in the art will understand that the methods of through-fluid bonding nonwoven webs described herein and illustrated in the accompanying drawings are non-limiting example forms and that the scope of the various non-limiting forms of the present disclosure are defined solely by the claims. The features illustrated or described in connection with one non-limiting form may be combined with the features of other non-limiting forms. Such modifications and variations are intended to be included within the scope of the present disclosure.

Nonwoven Webs

Nonwoven webs are useful in many industries, such as the hygiene industry, the dusting and cleaning implement industry, and the healthcare industry, for example. In the hygiene industry, nonwoven webs are used in the absorbent article field, such as use as components in diapers, pants, adult incontinence products, tampons, sanitary napkins, absorbent pads, bed pads, wipes, and various other products. Nonwoven webs may be used in diapers, pants, adult incontinence products, and/or sanitary napkins, for example, as topsheets, outer cover nonwoven materials, portions of leg cuffs, acquisition materials, core wrap materials, portions of ears and side panels, portions of fastener tabs, and/or secondary topsheets, for example. The nonwoven webs of the present disclosure are not limited to any certain industry and application, but can have application across many industries and applications.

Fiber Composition

The fibers of the nonwoven webs of the present disclosure may comprise multi-constituent fibers, such as bi-component fibers or tri-component fibers, for example, mono-component fibers, and/or other fiber types. Multi-constituent fibers, as used herein, means fibers comprising more than one chemical species or material (i.e., multi-component fibers). Bi-component fibers are used in the present disclosure merely as an example of multi-constituent fibers. The fibers may have round, triangular, tri-lobal, or otherwise shaped cross-sections, for example. It may be desirable to have fibers comprising more than one polymer component, such as bi-component fibers. Often, these two polymer components have different melting temperatures, viscosities, glass transition temperatures, and/or crystallization rates. As the multi-component fibers cool after formation, a first polymer component may solidify and/or shrink at a faster rate than a second polymer component while the second polymer component may have sufficient rigidity to resist compression along a longitudinal fiber axis. The continuous fibers may then deform and curl up when strain on the fiber is relieved, and thereby causing what is known as "crimp" in the fibers. Crimp of the fibers aids in the softness and loft of a nonwoven web, which is consumer desirable. Examples of bi-component fibers may comprise a first polymer component having a first melting temperature and a second polymer component having a second melting temperature. The first melting temperature of the first polymer component may be about 5 degrees C. to about 180 degrees C., about 10 degrees C. to about 180 degrees C., or about 30 degrees C. to about 150 degrees C., different than the second melting temperature of the second polymer component, thereby causing crimping of the fibers during cooling, specifically reciting all 0.1 degree C. increments within the specified ranges and all ranges formed therein or thereby. The first and second melting temperatures may differ by at least 5 degrees C., at least 10 degrees C., at least 20 degrees C., at least 25 degrees, at least 40 degrees C., at least 50 degrees C., at least 75 degrees C., at least 100 degrees C., at least 125 degrees C., at least 150 degrees C., but may all differ less than 180 degrees C., for example. As a further example, a first polymer component may comprise polypropylene and a second polymer component may comprise polyethylene. As yet another example, a first polymer component may comprise polyethylene and a second polymer component may comprise polyethylene terephthalate. As yet another example, a first polymer component may comprise polyethylene and a second polymer component may comprise polylactic acid. If tri-component fibers are used, at least one polymer component may have a different melting temperature (in the ranges specified above) than a melting temperature of at least one of the other two polymer components. The fibers may comprise petroleum sourced resins, recycled resins, or bio-sourced resins, such as polylactic acid from Nature Works and polyethylene from Braskem. The fibers may be or may comprise continuous fibers, such as spunbond fibers and melt-blown fibers. Staple fibers, either petroleum-sourced or bio-sourced, such as cotton, cellulous, and/or regenerated cellulous may also be included into the web and therefore are within the scope of the methods of the present disclosure. The multi-constituent fibers, such as bi-component fibers, may comprise sheath/core, side-by-side, islands in the sea, and/or eccentric configurations or may have other configurations.

Using thinner fibers may help through-fluid bonding intermediate continuous fiber nonwoven webs to create softer continuous fiber nonwoven webs. For example, the continuous fibers may have a decitex in the range of about 0.5 to about 5, about 0.8 to about 4, about 0.8 to about 3, about 0.8 to about 2, about 0.8 to about 1.5, about 1 to about 1.4, about 1.1 to about 1.3, or about 1.2, specifically reciting all 0.1 decitex increments within the specified ranges and all ranges formed therein or thereby.

General Continuous Fiber Nonwoven Formation Process

Many nonwoven webs are made from melt-spinnable polymers and are produced using a spunbond process. The term "spunbond" refers to a process of forming a nonwoven web from thin continuous fibers produced by extruding molten polymers from orifices of a spinneret. The continuous fibers are drawn as they cool. Quenching of the continuous fibers may be performed by blowing air onto the continuous fibers from one side or multiple sides under the spinneret in one or more open or enclosed chambers. Quench air temperature, flow rate, and humidity may be controlled in one or more stages located along the continuous fibers. Continuous fiber speed may be in range from about 1000 m/min to about 8000 m/min, for example, depending on the polymers selected. Air is the most common method of fiber attenuation in systems, such as mostly enclosed chambers developed by Reifenhauser GmbH, or by aspirators developed by Hills Inc., or inside Doncan systems developed by Lurgi GmbH. Mechanical methods, such as take-up rollers, or electrostatic methods may also be used for continuous fiber attenuation. After attenuation, the continuous fibers and are randomly laid on a moving porous member or moving porous belt, such that the continuous fibers form an intermediate continuous fiber nonwoven web. The intermediate continuous fiber nonwoven web is subsequently bonded using one of several known techniques, such as thermal point bonding, to form the nonwoven web. Spunbonding processes, however, result in low loft and softness in produced nonwoven webs due to the heavy thermal point bonding and reduced ability for the fibers to crimp on the moving porous member.

FIG. 1 diagrammatically illustrates an example apparatus 110 for producing continuous fiber nonwoven webs. The apparatus 110 may comprise a hopper 112 into which pellets of a solid polymer may be placed. The polymer may be fed from the hopper 112 to a screw extruder 114 that melts the polymer pellets. The molten polymer may flow through a heated pipe 116 to a metering pump 118 that in turn feeds the polymer stream to a suitable spin pack 120. The spin pack 120 may comprise a spinneret 122 defining a plurality of orifices 124 that shape the fibers extruded therethrough. The orifices may be any suitable shape, such as round, for example. If bi-component fibers are desired, another hopper 112', another screw extruder 114', another heated pipe 116', and another metering pump 118' may be included to feed a second polymer to the spinneret 122. The second polymer may be the same as or different than the first polymer. In some instances, the second polymer may be a different material and may have a different melting temperature as the first polymer as discussed herein. This difference in melting temperature allows formed bi-component fibers to crimp on the moving porous member as discussed herein. More than two polymer feed systems may also be included if 3 or more polymer components are desired.

Referring again to FIG. 1, an array of continuous fiber strands 126 may exit the spinneret 122 of the spin pack 120 and may be pulled downward by a drawing unit or aspirator 128, which may be fed by a fluid such as compressed air or steam from a conduit or other fluid source 130. Specifically, the aspirator 128 uses fluid pressure or air pressure to form a fluid flow or air flow directed generally downward toward the moving porous member, which creates a downward fluid drag or air drag on the continuous fiber strands, thereby increasing the velocity of the portion of the continuous fibers in and below the aspirator relative to the velocity of the portion of the continuous fibers above the aspirator. The downward drawing of the continuous fibers longitudinally stretches and transversely attenuates the continuous fibers. The aspirator 128 may be, for example, of the gun type or of the slot type, extending across the full width of the continuous fiber array, i.e., in the direction corresponding to a width of the intermediate nonwoven web to be formed by the continuous fibers. The area between the spinneret 122 and the aspirator 128 may be open to ambient air (open system) as illustrated or closed to ambient air (closed system).

The aspirator 128 delivers the attenuated continuous fibers 132 onto a moving porous member 134, such as a screen-type forming belt, which may be supported and driven by rolls 136 and 138 or other mechanisms. It is noted that the "moving porous members" disclosed herein may have sections or portions that are not porous, but at least some sections or portions of the moving porous members are able to have a fluid flow therethrough. A suction box 140 may provide a negative fluid pressure to the moving porous member 134 and the intermediate continuous fiber nonwoven web on the moving porous member 134. For example, the suction box 140 may be connected to a fan to pull room air (at the ambient temperature) through the moving porous member 134, causing the continuous fibers 132 to form an intermediate continuous fiber nonwoven web 200 on the moving porous member 134. The intermediate continuous fiber web 200 may pass through an optional compaction roll 142 that applies a very light pressure (e.g., about 10 to about 60 psi or less than 120 psi). In other instances, no compaction roll is used. The intermediate continuous fiber nonwoven web 200 may then be conveyed on the moving porous member 134 or other conveyer or belt into a through-fluid bonding oven 144. The through-fluid bonding ovens may take on various configurations as discussed in more details below.

If calendar bonding is not used, the intermediate continuous fiber nonwoven webs 200 may have a tendency to blow-back in a direction opposite a direction of movement of the moving porous member 134. This fiber blow-back is not desired because it may create high basis weight areas and low basis weight areas or even holes in the intermediate nonwoven web. As such, it may be desirable to pre-bond (as in bond before through-fluid bonding) the intermediate nonwoven web 200 at a location proximate to the suction box 140. The pre-bonding may provide the web with some structural integrity. The pre-bonding may be achieved by introducing a hot fluid, infrared technology, or other technology, such as a hot air, to the intermediate nonwoven web 200. As an example, the pre-bonding may occur via a short through-fluid bonding oven. The hot fluid may be provided by a fluid source 146 positioned over the moving porous member and proximate to the suction box 140. The fluid source 146 may be a perforated plate or multiple fluid sources, for example, so that less than 100%, less than 75%, less than 50%, less than 25%, but greater than 10% of a surface of the intermediate nonwoven web 200 not facing the moving porous member 134 receives pre-bonds. The pre-bonds may be intermittent in the cross-direction and/or the machine direction. It may be desirable to pre-bond less than 100% or less of the surface of the intermediate nonwoven web 200 so that the surface is not sealed and the continuous fibers of the webs are still allowed to further entangle with each other. The pre-bonds, however, do help in preventing, or at least inhibiting, fiber blow-back and providing the web 200 with some structural integrity.

In additional to pre-bonding, the intermediate nonwoven web 200 may be re-entangled prior to entering the through-fluid bonding oven 144. Re-entangling may occur by flowing a fluid, such as air, from a fluid source 148 from under the moving porous member 134 and into the intermediate nonwoven web 200. Re-entangling prior to through-fluid bonding may help with loft, softness, and fiber entanglement of the intermediate nonwoven web 200.

The various through-fluid bonding ovens and methods disclosed herein are configured to maintain loft and softness in the nonwoven web and allow the continuous fibers to crimp on the moving porous member, while still achieving suitable structural integrity. The various through-fluid bonding ovens and methods disclosed here also solve the problem of sidedness so that fairly uniform through-fluid bonding may be achieved on both surfaces of an intermediate continuous fiber nonwoven web to create a substantially uniformly through-fluid bonded continuous fiber nonwoven web.

The intermediate continuous fiber nonwoven web making process may be generally the same as explained herein relative to FIG. 1, including pre-bonding and/or fiber re-entangling and/or reorienting. The present disclosure will focus on concepts for the through-fluid bonding oven 144 of FIG. 1, although the through-fluid bonding ovens disclosed herein may also be used in other nonwoven manufacturing line configurations. The location of the through-fluid bonding oven 144 in FIG. 1 is merely an example location. FIGS. 2-4A are example through-fluid bonding oven designs.

Figure 2:
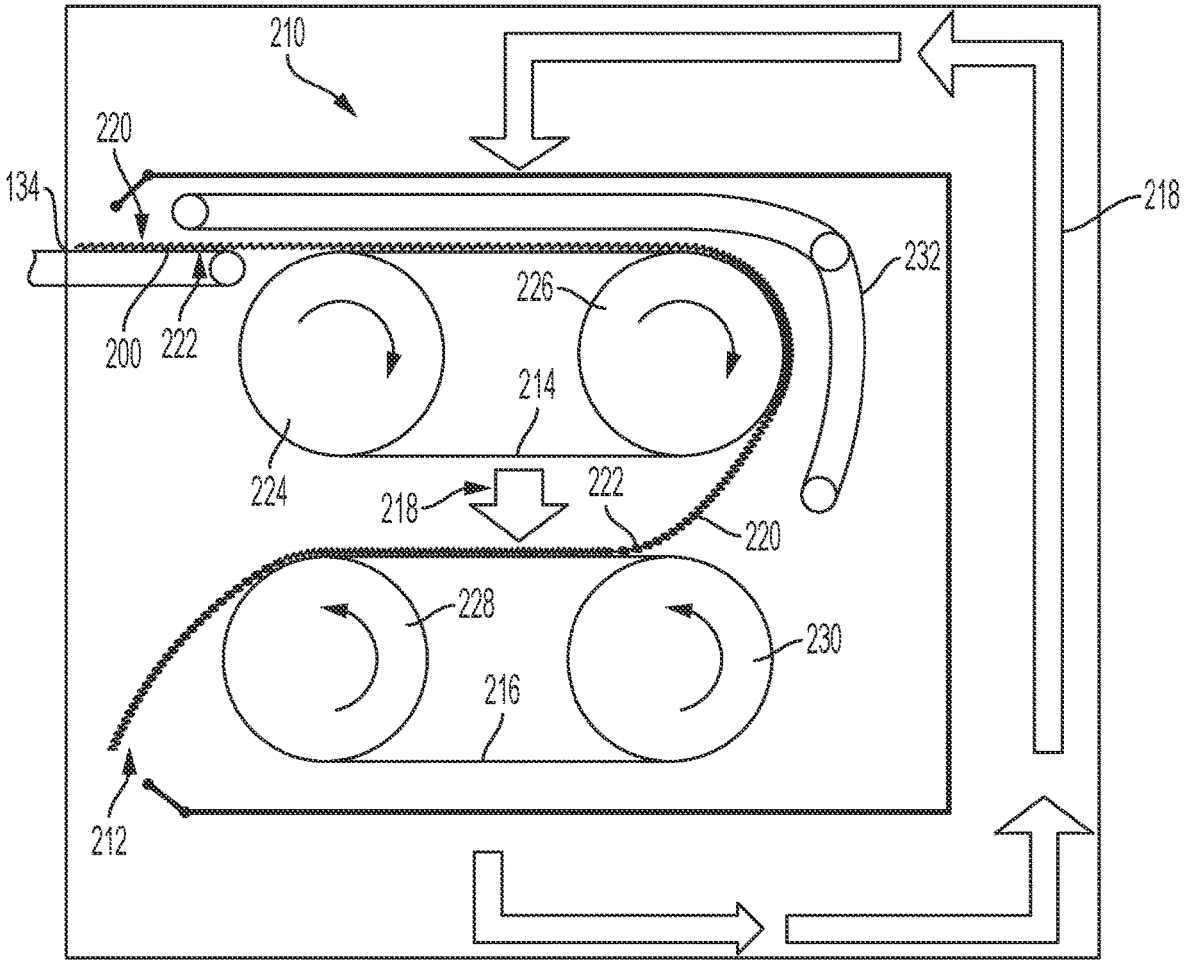
FIG. 2 is a diagrammatic view of a through-fluid bonding oven comprising a first porous member and a second porous member.

FIG. 2 is a schematic illustration of a through-fluid bonding oven 210 of the present disclosure. The intermediate continuous fiber nonwoven web 200 is conveyed on the moving porous member 134 into the through-fluid bonding oven 210 and onto a first porous member 214. The web 200 may be intermittently pre-bonded with a heated fluid prior to being conveyed into the through-fluid bonding oven 210. The web 200 may be re-entangled and/or reoriented prior to being conveyed into the through-fluid bonding oven 210. The web 200 may also be re-entangled and/or reoriented and intermittently pre-bonded with a heated fluid prior to being conveyed into the through-fluid bonding oven 210. The web 200 may not be calendar bonded prior to being conveyed into the through-fluid bonding oven 210.

The intermediate continuous fiber nonwoven web 200 may be transferred from the moving porous member 134 or other conveyer or belt onto a first porous member 214, either before or after entry into the through-fluid bonding oven 210. The moving porous member 134 and the first porous member 214 may be positioned such that the web 200 approaches and enters the oven 210 without a substantial turn in the machine direction. This may be desired since the web 200 may not have a substantial amount of structural integrity prior to the bonding that occurs in the oven 210. Ideally, the moving porous member 134 may have an angle of about zero degrees with the first porous member 214. In other instances, it may be desired to have the angle be in the range of about −40 degrees to about 40 degrees, about −30 degrees to about 30 degrees, about −20 degrees to about 20 degrees, about −10 degrees to about 10 degrees, about −5 degrees to about 5 degrees, about −3 degrees to about 3 degrees, about −2 degrees to about 2 degrees, or about −1 degree to about 1 degree, specifically reciting all 0.5 degree increments within the specified ranges and all ranges formed therein or thereby. At least a portion of, or all of, the first porous member 214 may be positioned within the through-fluid bonding oven 210. At least a portion of, or all of, a second porous member 216 may be positioned within the through-fluid bonding oven 210. The first and second porous members 214 and 216 may be a screen-type belt, for example. It is noted that the "porous members" and "moving porous members" disclosed herein may have sections or portions that are not porous, but at least some sections or portions of the porous members are able to have a fluid (e.g., heated air) flow therethrough. The first porous member 214 and second porous member 216 may be moveable or driven in the directions shown by the arrows. The first porous member 214 may be positioned above or below the second porous member 216 in the through-fluid bonding oven 210. A third porous member 232 may be positioned above the first porous member 214. Optionally, a fourth porous member or other porous members may be positioned between the first and second porous members 214 and 216.

The first porous member 214 may be positioned around a first roller 224 and a second roller 226, for example. The first porous member 214 may be supported and driven by the first and second rollers 224 and 226, or other mechanisms. The second porous member 216 may be positioned around a third roller 228 and a fourth roller 230. The second porous member 216 may be supported and driven by the third and fourth rollers 228 and 230, or other mechanisms. The first porous member 214 may be driven in a first direction (as indicated by the arrows). The second porous member 216 may be driven in a second, different direction (as indicated by the arrows). The first porous member 214 may be driven independent of the second porous member 216 at the same speed or at different speeds. For example, the first porous member 214 may be driven at a faster or a slow speed than the second porous member 216.

The web 200 may be transported in one direction on a plurality of porous members. For example, the transport path defined by the first porous member 214 as shown in FIG. 2 may be comprised of two, three, or more individually driven porous members. Additionally, the transport path defined by the second porous member 216 as shown in FIG. 2 may be comprised of two, three, or more individually driven porous members. The individually driven porous members may be driven at varying speeds relative to each other. For example, a first porous member may be driven at a faster or slower speed than a second porous member. A transport path for the web 200 comprised of a plurality of porous members driven at varying speeds may be beneficial to account for shortening or shrinking of the web 200 as the continuous fibers are through-fluid bonded. This may promote loft and softness in the web.

Referring still to FIG. 2, a first surface 222 of the intermediate continuous fiber nonwoven web 200 may be in face-to-face contact with the first porous member 214 as the web 200 is conveyed into the through-fluid bonding oven 210. A second surface 220 of the intermediate continuous fiber nonwoven web 200 may be facing away from the first porous member 214 as the web 200 is conveyed into the through-fluid bonding oven 210. The second surface 220 of the web 200 may be in face-to-face contact with a third porous member 232. The third porous member 232 may also be positioned about 0.1 mm to about 50 mm, about 0.5 mm to about 50 mm, or about 1 mm to about 20 mm, away from the second surface 220 of the web 200. The third porous member 232 may also have portions that are non-porous, but may have at least some portions that are porous. The third porous member 232 may help reduce fiber blow-back and help transport the web 200 by shear forces intermediate the third porous member 232 and the first porous member 214. A surface of the third porous member 232 contacting the web 200 may move in the same direction as the web 232.

The web 200 may be transferred from the first porous member 214 to the second porous member 216. Upon transfer, the second surface 220 of the web 200 may be in face-to-face contact with the second porous member 216, while the first surface 222 of the web 200 may face away from the second porous member 216. As such, the web 200 is essentially flipped over in the oven 210. The first porous member 214 and the second porous member 216 may be positioned such that when the second surface 220 of the web 200 is in face-to-face contact with the second porous member 216, the first surface 222 of the web 200 is in face-to-face contact with the first porous member 214. The first porous member 214 may also be positioned about 0.1 mm to about 50 mm, about 0.5 mm to about 50 mm, or about 1 mm to about 20 mm, away from the first surface 222 of the web 200, as the web 200 is conveyed on the second porous member 216.

Without wishing to be bound by theory, it is hypothesized that the "stacked" or "sandwiched" arrangement of the first porous member 214 and the third porous member 232, and optionally of the second porous member 216 and the first porous member 214, allows the web 200 to be transported or assisted in transport by shear forces which consequently allows a machine direction strain to be reduced, even to a negative machine direction strain or a very low machine direction strain. When the web 200 is transported through a portion of the oven or all of the oven assisted by shear forces, the machine direction strain of the web may be in the range of about −15% to about 5%, about −10% to about 5%, about −5% to about 5%, about −2% to about 5%, about −2% to about 3%, about −2% to about 1.8%, about −2% to about 1.5%, or about −2% to about 0.5%, for example. Machine direction strain of the web may be defined as the ((present length of the web minus original length of the web at entry of the device where the web transport is assisted by shear)/original length of the web)×100%. Additionally, the "stacked" arrangement of the first, second, and third porous members 214, 216, and 232 helps in preventing, or at least inhibiting, fiber blow-back and providing the web 200 with some structural integrity.

Referring again to FIG. 2, a heated fluid 218, such as hot air, may be flowed through the web 200, the first porous member 214, the web 200 again, and then flowed through the second porous member 216 within the through-fluid bonding oven 210 in one direction. The heated fluid 218 may flow through the through-fluid bonding oven 210 at a flow rate in the range of about 5 m/s to about 0.5 m/s. The heated fluid 218 may be heated to a range of 10 degrees C. to about 280 degrees C., for example. The heated fluid 218 may be recirculated within the through-fluid bonding oven 210 or may be recirculated outside of the through-fluid bonding oven 210 (as shown by the arrows). The heated fluid 218 may receive additional heat during the recirculation step. Alternatively, the heated fluid 218 may not be recirculated. In some instances, it may be desirable to cool the web 200 within or immediately outside the through-fluid bonding oven 210 to set the fiber-to-fiber bonding.

When the third porous member 232 is present above the first porous member 214, the heated fluid 218 may first flow through the third porous member 232 prior to flowing through the web and the first porous member 214. The heated fluid 218 may also flow through the oven 210 such that the heated fluid 218 flows through the second porous member 216 prior to flowing through the first porous member 214. In essence, the heated fluid 218 may flow generally in the opposite direction while still achieving the desired result.

The first surface 222 of the web 200 may be bonded using the first porous member 214 as the first surface 222 is conveyed on the first porous member 214. Bonding of the first surface 222 on the first porous member 214 may be accomplished through conductive heat transfer from the first porous member 214 to the first surface 222. Bonding of the second surface 220 facing away from the first porous member 214 may be accomplished by convective heat transfer. If the third porous member 232 is in contact with the second surface 220, bonding of the second surface 220 may occur through conductive heat transfer. Contact between both surfaces of the web 200 one of the first, second and third porous members is desired since conductive heat transfer can occur compared to merely convective heat transfer. Conductive heating, by allowing the surface of a web to contact a heated porous belt, tends to be more efficient at achieving surface bonding as compared to convective heating, especially with regard to porous, low basis weight nonwoven webs. Velocity of the heated fluid 218 through the bonding oven 210 may be adjusted to control the contact pressure between the nonwoven web 200 and the first and second porous members 214 and 216. It may be desired not to exert high air pressure that may damage the lofty structure of the nonwoven web 200. Velocity of the heated fluid 218 may be more than 0.5 m/s for sufficient contact between web and first and second porous members 214 and 216. Velocity of the heated fluid 218 of less than 5 m/s may prevent, or at least inhibit, loss of loft in the web 200. Velocity of the heated fluid 218 through the through-fluid bonding oven 210 may be in a range of about 0.5 m/s to about 5 m/s, about 0.5 m/s to about 2.5 m/s, about 0.5 m/s to about 2 m/s, or about 0.5 m/s to about 1.5 m/s, for example. It may also be desired that the web 200 resides within the through-fluid bonding oven 210 for a period of time between about 5 seconds and about 45 seconds, between about 7 seconds and about 30 seconds, or between about 10 seconds and about 25 seconds, for example. A residence time in the oven in these ranges may allow the web 200 to achieve optimal loft and bonding sufficiency.

Upon transfer of the web 200 to the second porous member 216, the second surface 220 of the web 200 may be bonded using the second porous member 216 through conductive heat transfer. Bonding of the first surface 222 may also be achieved by convective heat transfer while facing away from the second porous member 216. Sidedness may be reduced by flipping the web 200 over in the through-fluid bonding oven 210 so that both sides receive the same conductive and convective heat transfer within the oven 210. Bonding of the first surface 222 and the second surface 220 of the intermediate continuous fiber nonwoven web 200 as described above may result in a continuous fiber nonwoven web 212 that has increased loft and softness with reduced sidedness and suitable structural integrity.

Methods/Examples

A method of through-fluid bonding an intermediate continuous fiber nonwoven web is provided. The method may comprise providing a through-fluid bonding oven comprising a first porous member and a second porous member. The method may comprise driving the first porous member and the second porous member. The first porous member may be positioned above or below the second porous member. The method may comprise flowing a heated fluid, such as heated air, through the first and second porous members within the through-fluid bonding oven. The heated fluid may be flowed in one direction (e.g., flowing the heated fluid so that it first flows through the first porous member before flowing through the second porous member). The heated fluid may also be flowed in an opposite direction, as discussed above. The method may comprise conveying the intermediate continuous fiber nonwoven web into the through-fluid bonding oven and onto the first porous member. A first surface of the intermediate continuous fiber nonwoven web may be in face-to-face contact with the first porous member, and a second surface of the intermediate continuous fiber nonwoven web may be facing away from the first porous member. The method may comprise using the first porous member (e.g., via conductive heating) to bond the first surface of the intermediate continuous fiber nonwoven web as the first surface is conveyed on the first porous member. The method may comprise transferring the intermediate continuous fiber nonwoven web to the second porous member. The second surface of the intermediate continuous fiber nonwoven web may be in face-to-face contact with the second porous member, and the first surface of the nonwoven web may be facing away from the second porous member. The method may comprise using the second porous member (e.g., via conductive heating) to bond the second surface of the intermediate continuous fiber nonwoven web as the second surface is conveyed on the second porous member to create a continuous fiber nonwoven web. The method may comprise bonding the second surface of the web while the web is being conveyed on the first porous member and bonding the first surface of the web while the web is being conveyed on the second porous member. These bonding steps may comprise convective bonding.

The method may comprise positioning the first porous member around first and second rollers. The method may comprise positioning the second porous member around third and fourth rollers. The first porous member may be driven around the first and second rollers. The second porous member may be driven around the third and fourth rollers. The first porous member may be driven in a first direction when the first porous member is in contact with the first surface of the web. The second porous member may be driven in a second, different direction when the second porous member is in contact with the second surface of the web.

The method may comprise providing a third porous member. The third porous member may be positioned such that the intermediate continuous fiber nonwoven web is conveyed intermediate the third porous member and the first porous member. The web may be in face-to-face contact with the third porous member, or the third porous member may be positioned about 0.1 mm to about 50 mm, about 0.5 mm to about 50 mm, or about 1 mm to about 20 mm, away from the second surface of the web. The method may comprise reducing the machine direction strain of the intermediate continuous fiber nonwoven web intermediate the first and third porous members. The machine direction strain may be reduced to less than 1.8%, or any other range specified herein. Stated differently, the web may be conveyed intermediate the first and third porous members by shear, thereby allowing the machine direction strain of the web to be reduced. This may provide softness and loft to the web.

The intermediate continuous fiber nonwoven web may comprise bi-component fibers comprising a first polymer component and a second polymer component. In an example, the bi-component fibers may comprise polypropylene and polyethylene. In another example, the bi-component fibers may comprise polyethylene and polyethylene terephthalate. In another example, the bi-component fibers may comprise a first polymer component and a second polymer component, wherein a melting temperature of the first polymer component may be different than a melting temperature of the second polymer component by at least 10 degrees C., or at least 30 degrees C., but less than 180 degrees C., for example.

The fibers of the intermediate continuous fiber nonwoven web may comprise crimped fibers. The web may have a denier less than 1.2 decitex. Smaller decitex fibers may be easier to through-fluid bond.

The method may comprise not calendar bonding the intermediate continuous fiber nonwoven web prior to conveying the web into the through-fluid bonding oven. The method may comprise intermittently pre-bonding the intermediate continuous fiber nonwoven web with a heated fluid, such as heated air, prior to conveying the web into the through-fluid bonding oven. The method may comprise re-entangling the intermediate continuous fiber nonwoven web prior to conveying the web into the through-fluid bonding oven.

The method may comprise flowing the heated fluid through the first porous member prior to flowing the heated fluid through the second porous member. When the method comprises a third porous member, the method may comprise flowing the heated fluid first through the third porous member prior to flowing the heated fluid through the first and second porous members. The method may comprise recirculating the heated fluid after flowing the heated fluid through the first and second (and optionally third) porous members. The heated fluid may or may not be reheated during recirculation. The heated fluid may be in the range of about 10 degrees C. to about 280 degrees C. The method may comprise cooling the intermediate continuous fiber nonwoven web after or during the flowing a heated fluid step.

The method may comprise the step of finally bonding the intermediate continuous fiber nonwoven web to create a continuous fiber nonwoven web. The web may be finally bonded on the first surface and on the second surface to reduce sidedness of the web. The web may be finally bonded by conductive heat transfer and convective heat transfer on both the first surface and the second surface to reduce sidedness of the web. The residence time of the intermediate continuous fiber nonwoven web within the through-fluid oven may be in the range of about 5 seconds and about 40 seconds, about 7 seconds to about 30 seconds, or about 10 seconds to about 25 seconds, for example.

A through-air bonded nonwoven web may comprise a plurality of continuous fibers. The plurality of continuous fiber may comprise bi-component fibers comprising a first polymer component and a second polymer component. The first polymer component may have a different melting temperature than the second polymer component by at least 10 degrees C., but less than 180 degrees C. The web may comprise a first surface and a second surface. The first surface may be finally bonded by conductive heat transfer and convective heat transfer and the second surface may be finally bonded by conductive heat transfer and convective heat transfer.

Examples/Combinations

A. A method of through-fluid bonding an intermediate continuous fiber nonwoven web to create a continuous fiber nonwoven web, the method comprising:

providing a through-fluid bonding oven;

the through-fluid bonding oven comprising a first porous member and a second porous member;

driving the first porous member;

driving the second porous member;

flowing a heated fluid through the first and second porous members within the through-fluid bonding oven in one direction;

conveying the intermediate continuous fiber nonwoven web into the through-fluid bonding oven and onto the first porous member, wherein a first surface of the intermediate continuous fiber nonwoven web is in face-to-face contact with the first porous member, and wherein a second surface of the intermediate continuous fiber nonwoven web is facing away from the first porous member;

using the first porous member to bond the first surface of the intermediate continuous fiber nonwoven web as the first surface is conveyed on the first porous member;

transferring the intermediate continuous fiber nonwoven web to the second porous member, wherein the second surface of the intermediate continuous fiber nonwoven web is in face-to-face contact with the second porous member, and wherein the first surface of the nonwoven web is facing away from the second porous member; and using the second porous member to bond the second surface of the intermediate continuous fiber nonwoven web as the second surface is conveyed on the second porous member to create a continuous fiber nonwoven web;

wherein the intermediate continuous fiber nonwoven web comprises bi-component fibers comprising a first polymer component and a second polymer component, and wherein the first polymer component has a different melting temperature than the second polymer component by at least 10 degrees C., but less than 180 degrees.

B. The method of Paragraph A, wherein the first polymer component comprises polypropylene and the second polymer component comprises polyethylene.

C. The method of Paragraph A, wherein the first polymer component comprises polyethylene the second polymer component comprises polyethylene terephthalate.

D. The method of any one of Paragraphs A-C, wherein the first porous member is positioned above or below second porous member.

E. The method of any one of Paragraphs A-D, wherein the first porous member is positioned around first and second rollers, and wherein the second porous member is positioned around third and fourth rollers, the method comprising:

driving the first porous member around the first and second rollers; and driving the second porous member around the third and fourth rollers.

F. The method of any one of Paragraphs A-E, comprising:

a) flowing the heated fluid through the first porous member; and b) flowing the heated fluid through the second porous member;

wherein steps a) and b) are performed in order.

G. The method of Paragraph F, comprising recirculating the heated fluid after flowing the heated fluid through the second porous member.

H. The method of any one of Paragraphs A-G, wherein the heated fluid is in the range of about 10 degrees C. to about 280 degrees C.

I. The method of any one of Paragraphs A-H, comprising:

conveying the first porous member in a first direction when the first porous member is in contact with the first surface of the intermediate continuous fiber nonwoven web; and conveying the second porous member in a second, different direction when the second porous member is in contact with the second surface of the continuous fiber nonwoven web.

J. The method of Paragraph I, wherein the first and second porous members are independently driven.

K. The method of any one of Paragraphs A-J, wherein fibers of the intermediate continuous fiber nonwoven web comprise crimped fibers.

L. The method of any one of Paragraphs A-K, comprising a third porous member, wherein the intermediate continuous fiber nonwoven web is positioned intermediate the third porous member and the first or second moving porous member.

M. The method of Paragraph L, comprising reducing a machine direction strain of the intermediate continuous fiber nonwoven web.

N. The method of Paragraph M, wherein the machine direction strain is less than 1.8%.

O. The method of Paragraph M, wherein the machine direction strain is negative.

P. The method of any one of Paragraphs A-O, wherein the intermediate continuous fiber nonwoven web is not calendar bonded prior to being conveyed into the through-fluid bonding oven.

Q. The method of any one of Paragraphs A-P, wherein the intermediate continuous fiber nonwoven web is intermittently pre-bonded with a heated fluid prior to being conveyed into the through-fluid bonding oven.

R. The method of Paragraph Q, wherein less than 100% of the intermediate continuous fiber nonwoven web is intermittently pre-bonded prior to being conveyed into the through-fluid bonding oven.

S. The method of any one of Paragraphs A-R, wherein the intermediate continuous fiber nonwoven web is re-entangled prior to being conveyed into the through-fluid bonding oven.

T. The method of any one of Paragraphs A-S, wherein continuous fibers of the continuous fiber nonwoven web have a denier less than 1.2 decitex.

U. The method of any one of Paragraphs A-T, comprising cooling the intermediate continuous fiber nonwoven web after or during the flowing a heated fluid step.

V. A through-air bonded nonwoven web, comprising a plurality of continuous fibers, wherein the plurality of continuous fiber comprise bi-component fibers comprising a first polymer component and a second polymer component, and wherein the first polymer component has a different melting temperature than the second polymer component by at least 10 degrees C., but less than 180 degrees C.;

a first surface;

a second surface;

wherein the first surface is finally bonded by conductive heat transfer and convective heat transfer; and wherein the second surface is finally bonded by conductive heat transfer and convective heat transfer.

Figure 3:
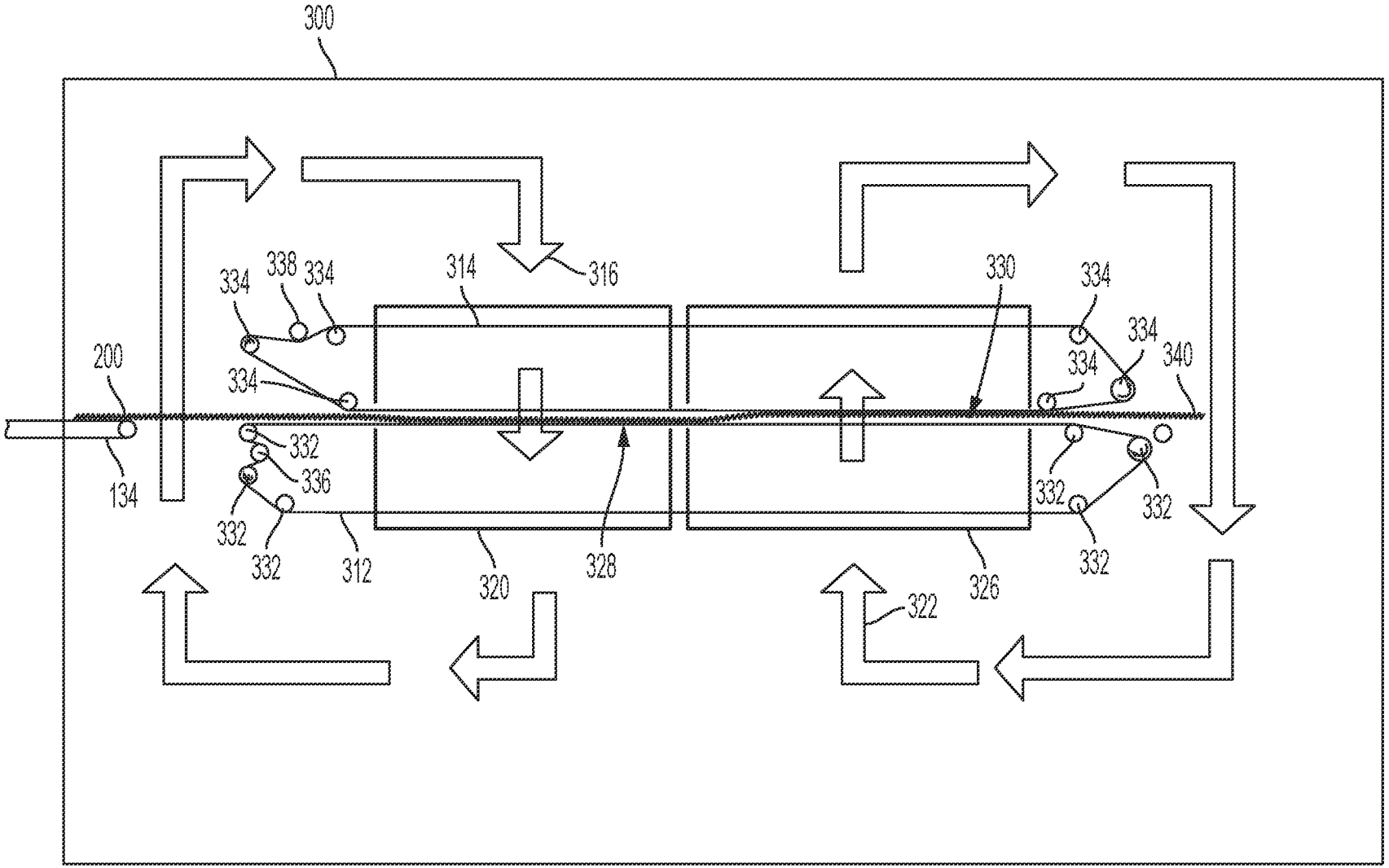
FIG. 3 is a diagrammatic view of a through-fluid bonding oven comprising a first zone and a second zone.

FIG. 3 is a schematic illustration of a through-fluid bonding oven 300 of the present disclosure. The intermediate continuous fiber nonwoven web 200 may be conveyed on the moving porous member 134 or other belt or conveyor into the through-fluid bonding oven 300 and onto a first porous member 312. Continuous fibers of the web 200 may be intermittently pre-bonded with a heated fluid or re-entangled and/or reoriented prior to being conveyed into the through-fluid bonding oven 300. The web 200 may not be calendar bonded prior to being conveyed into the through-fluid bonding oven 300.

Referring to FIG. 3, the web 200 may be transferred from the moving porous member 134 or other conveyer or belt onto a first porous member 312, either before or after entry into the through-fluid bonding oven 300. The moving porous member 134 and the first porous member 312 may be positioned such that the web 200 approaches and enters the oven 300 without a substantial turn in the machine direction. This may be desired since the web 200 may not have a substantial amount of structural integrity prior to the bonding that occurs in the oven 300. Ideally, the moving porous member 134 may have an angle of about zero degrees with the first porous member 312. In other instances, it may be desired to have the angle be in the range of about −40 degrees to about 40 degrees, about −30 degrees to about 30 degrees, about −20 degrees to about 20 degrees, about −10 degrees to about 10 degrees, about −5 degrees to about 5 degrees, about −3 degrees to about 3 degrees, about −2 degrees to about 2 degrees, or about −1 degree to about 1 degree, specifically reciting all 0.5 degree increments within the specified ranges and all ranges formed therein or thereby. At least a portion of, or all of, the first porous member 312 may be positioned within the through-fluid bonding oven 300. At least a portion of, or all of, a second porous member 314 may be positioned within the through-fluid bonding oven 300. The first and second porous members 312 and 314 may be a screen-type belt, for example. As mentioned above, it is noted that the "porous members" and "moving porous members" disclosed herein may have sections or portions that are not porous, but at least some sections or portions of the moving porous members are able to have a fluid flow therethrough. The first and second porous members 312 and 314 may be moveable or driven such that the web 200 travels from left to right. The first porous member 312 may be positioned below the second porous member 314.

The first porous member 312 may be positioned around a first set of rollers 332. The first porous member 312 may be supported and driven by the first set of rollers 332, or other mechanisms. One roller of the first set of rollers 332 may be a first tensioner 336. The second porous member 314 may be positioned around a second set of rollers 334. The second porous moveable member 314 may be supported and driven by the second set of rollers 334, or other mechanisms. One roller of the second set of rollers 334 may be a second tensioner 338. The first moveable porous member 312 may be driven in a first direction (as indicated by the arrows). The second moveable porous member 314 may be driven in a second, different direction (as indicated by the arrows). The first porous member 312 may be driven independent of the second porous member 314.

The web 200 may be transported in one direction on a plurality of porous members. For example, the transport path defined by the first porous member 312 as shown in FIG. 3 may be comprised of two, three, or more individually driven porous members. Additionally, the transport path defined by the second porous member 314 as shown in FIG. 3 may be comprised of two, three, or more individually driven porous members. The individually driven porous members may be driven at varying speeds relative to each other. For example, a first porous member may be driven at a faster or slower speed than a second porous member. A transport path for the web 200 comprised of a plurality of porous members driven at varying speeds may be beneficial to account for shortening or shrinking of the web 200 as the continuous fibers are through-fluid bonded. This may promote loft and softness in the web.

Referring again to FIG. 3, a first surface 328 of the intermediate continuous fiber nonwoven web 200 may be in face-to-face contact with the first porous member 312 as the web 200 is conveyed into the through-fluid bonding oven 300. A second surface 330 of the web 200 may be facing away from the first porous member 312. The second surface 330 of the web 200 may be in face-to-face contact with the second porous member 314. The second porous member 314 may also be positioned about 0.1 mm to about 50 mm, about 0.5 mm to about 50 mm, or about 1 mm to about 20 mm, away from the second surface 330 of the web 200.

Without wishing to be bound by theory, it is hypothesized that the "stacked" or "sandwiched" arrangement of the first porous member 312 and the second porous member 314 allows the web 200 to be transferred by shear forces which consequently allows a machine direction strain to be reduced, even to a negative machine direction strain. When the web 200 transport through a portion of the oven 300 is assisted by shear, the machine direction tension may be in the range of about −15% to about 5%, about −10% to about 5%, about −5% to about 5%, about −2% to about 5%, about −2% to about 3%, about −2% to about 1.8%, about −2% to about 1.5%, or about −2% to about 0.5%, for example. Machine direction strain may be defined as the ((present length of the web minus original length of the web at entry of the device where the web transport is assisted by shear)/original length of the web)×100%. Additionally, the "stacked" arrangement of the first and second porous members 312 and 314 helps in preventing, or at least inhibiting, fiber blow-back and providing the web 200 with some structural integrity.

The through-fluid bonding oven 300 may comprise a first zone 320 and a second zone 326. Within the first zone 320, a first heated fluid 316, such as hot air, may be flowed in a first direction through the second porous member 314, the web 200, and then flowed through the first porous member 312, as indicated by the arrows in FIG. 3. Alternatively, the first heated fluid 316 may be flowed in a second direction, where the first heated fluid 316 first flows through the first porous member 312, the web 200, and then through the second porous member 314. When the heated fluid 316 is flowed in a first direction, the first heated fluid 316 may force the first surface 328 of the web 200 against the first porous member 312. Alternatively, when the heated fluid 316 is flowed in a second direction, the first heated fluid 316 may force the second surface 330 against the second porous member 314. The first heated fluid 316 may flow through the first zone 320 of the through-fluid bonding oven 300 at a flow rate in the range of about 5 m/s to about 0.5 m/s.

Within the second zone 326, a second heated fluid 322, such as hot air, may be flowed in a direction generally opposite that of the flow of the first heated fluid 316. Therefore, when the first heated fluid 316 is flowed in a first direction (i.e., first through the second porous member 314, the web 200, and then through the first porous member 312), the second heated fluid 322 may be flowed in a second direction. Alternatively, when the first heated fluid is flowed in a second direction (i.e., first through the first porous member 312, the web 200, then through the second moving porous member 314), the second heated fluid 322 may be flowed in a first direction. The second heated fluid 322 may flow through the second zone 326 of the through-fluid bonding oven 300 at a flow rate in the range of about 5 m/s to about 0.5 m/s. Flowing the fluids in the two zones in opposite directions causes the web 200 to encounter conductive fluid transfer on both surfaces. Multiple zones of different directional fluid flow may also be provided.

Figure 3A:
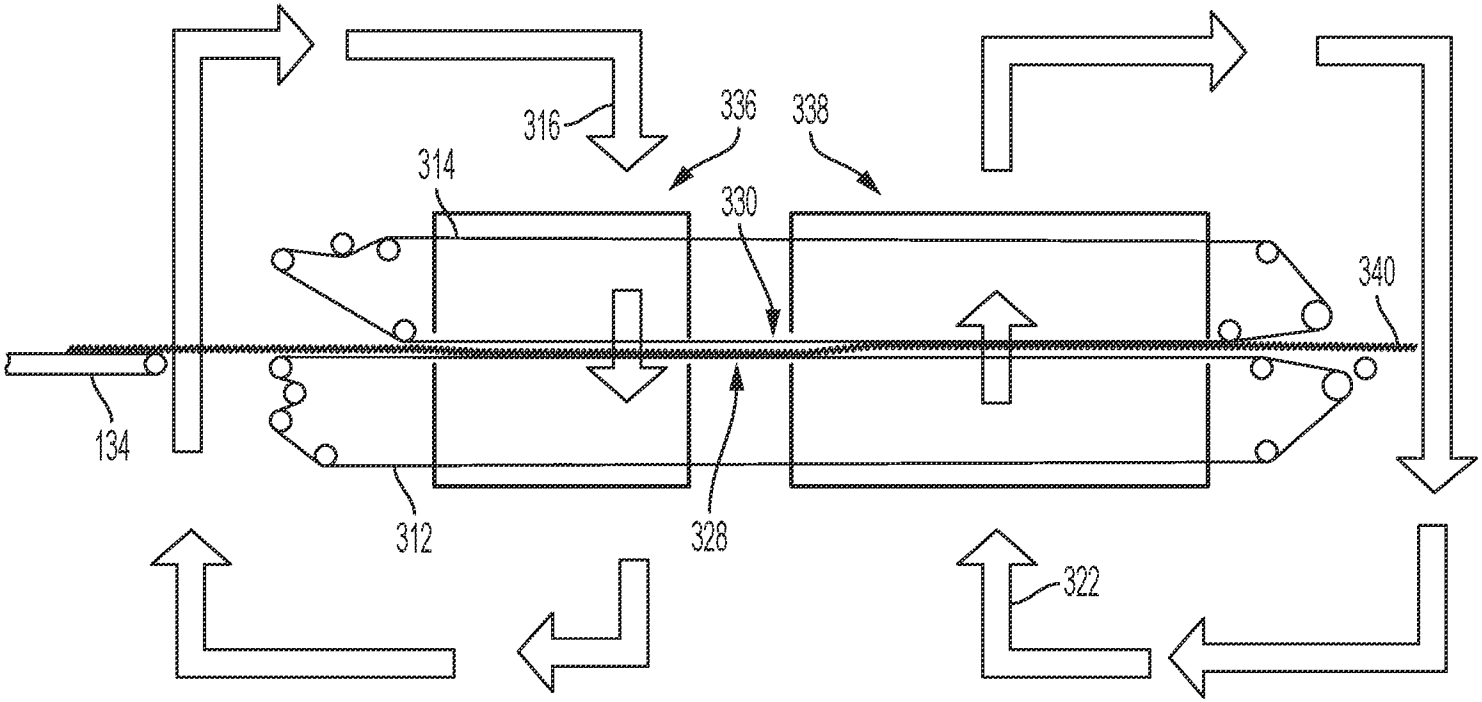
FIG. 3A is a diagrammatic view of a through-fluid bonding process comprising a first through-fluid bonding oven and a second through-fluid bonding oven.

Referring now to FIG. 3A, the intermediate continuous fiber nonwoven web 200 may be conveyed on the moving porous member 134 or first porous member 312 into a first through-fluid bonding oven 336 followed by a second through-fluid bonding oven 338. The first and second through-fluid bonding ovens 336 and 338 may replace or be in addition to the first zone 320 and second zone 326 of the through-fluid bonding oven 300 of FIG. 3. As such, within the first through-fluid bonding oven 336, the first heated fluid 316 may be flowed in a first direction. Alternatively, the first heated fluid 316 may be flowed in a second direction within the first through-fluid bonding oven 336. Within the second through-fluid bonding oven 338, the second heated fluid 322 may be flowed in a direction generally opposite that of the flow direction of the first heated fluid 316. For example, the first heated fluid 316 may be flowed in a first direction (flowing first through the second porous member 314, the web 200, and then through the first porous member 312) within the first through-fluid bonding oven 336. This may force the first surface 328 of the web 200 against the first porous member 312. Next, the second heated fluid 322 may flow in a second direction (flowing first through the first porous member 312, the web 200, and then through the second porous member 314) within the second through-fluid bonding oven 338. This may force the second surface 330 of the web 200 against the second porous member 314. As in FIG. 3, flowing the fluids in opposite directions allows the web 200 to experience conductive heat transfer on both surfaces. More than two through-fluid bonding ovens are also within the scope of the present disclosure. As an example, two or more through-fluid bonding ovens may flow the heated fluid in a first direction and two or more through-fluid bonding ovens may flow the heated fluids in a second, different direction.

Referring again to FIG. 3A, the first and second porous members 312 and 314 may form a continuous conveyor through both the first and second through-fluid bonding ovens 336 and 338. In an alternative example, the web 200 may be conveyed intermediate first and second porous members through the first through-fluid bonding oven. The web 200 may then be conveyed intermediate a third and fourth porous members through the second through-fluid bonding oven.

The first and second heated fluids 316 and 322 may be heated to a range of about 10 degrees C. to about 280 degrees C., for example. The first and second heated fluids 316 and 322 may be recirculated within the through-fluid bonding oven 300 (as shown by the arrows) or may be recirculated outside of the through-fluid bonding oven 300. The first and second heated fluids 316 and 322 may or may not receive additional heat during the recirculation step. Alternatively, the first and second heated fluids 316 and 322 may not be recirculated. The same recirculation may apply to the example through-fluid bonding ovens of FIG. 3A. In some instances, it may be desirable to cool the web 200 within or immediately outside the through-fluid bonding oven 300 to set the fiber-to-fiber bonding.

The first surface 328 of the web 200 may be bonded using the first porous member 312 as the first surface 328 is forced into contact with the first porous member 312 by the first heated fluid 316 within the first zone 320 (or within the first through-fluid bonding oven 336 as shown in FIG. 3A). Bonding of the first surface 328 using the first porous member 312 may be accomplished through conductive heat transfer from the first porous member 312 to the first surface 328. Bonding of the second surface 330 facing away from the first porous member 312 may be accomplished by convective heat transfer in the first zone 320 (or in the first through-fluid bonding oven 336). Conductive heating, by allowing the surface of a web to contact a heated porous belt, tends to be more efficient at achieving surface bonding as compared to convective heating, especially with regard to porous, low basis weight nonwoven webs. Velocity of the heated fluids 316 and 322 through the bonding oven 300 may be adjusted to control the contact pressure between the nonwoven web 200 and the first and second porous members 312 and 314. It may be desired not to exert high air pressure that may damage the lofty structure of the nonwoven web 200. Velocity of the heated fluids 316 and 322 may be more than 0.5 m/s for sufficient contact between web and first and second porous members 312 and 314. Velocity of the heated fluids 316 and 322 of less than 5 m/s may prevent, or at least inhibit, loss of loft in the web 200. Velocity of the heated fluids 316 and 322 through the through-fluid bonding oven 300 may be in a range of about 0.5 m/s to about 5 m/s, about 0.5 m/s to about 2.5 m/s, about 0.5 m/s to about 2 m/s, or about 0.5 m/s to about 1.5 m/s, for example. It may also be desired that the web 200 resides within the through-fluid bonding oven 300 for a period of time between about 5 seconds and about 45 seconds, between about 7 seconds and about 30 seconds, or between about 10 seconds and about 25 seconds, for example. A residence time in the oven in these ranges may allow the web 200 to achieve optimal loft and bonding sufficiency.

Upon conveyance of the web 200 into the second zone 326 (or into the second through-fluid bonding oven 338 as shown in FIG. 3A), the second surface 330 may be bonded through conductive heat transfer from the second porous member 314 to the second surface 330 as the second surface 330 is forced into contact with the second porous member 314 by the second heated fluid 322. Bonding of the first surface 328 may also be achieved by convective heat transfer while facing away from the second porous member 314 in the second zone 326 (or in the second through-fluid bonding oven 338). Sidedness may be reduced by alternatively forcing the first surface 328 and the second surface 330 of the web 200 into contact with the first and second movable porous members 312 and 314 so that both sides receive the same, or somewhat similar, conductive and convective heat transfer within the through-fluid bonding oven or ovens. Bonding of the first surface 328 and the second surface 330 of the intermediate continuous fiber nonwoven web 200 as described above may result in a continuous fiber nonwoven web 340 that has increased loft and softness with reduced sidedness and suitable structural integrity.

Methods/Examples

A method of through-fluid bonding an intermediate continuous fiber nonwoven web is provided. The method may comprise providing a through-fluid bonding oven comprising a first porous member and a second porous member. The method may comprise conveying the intermediate continuous fiber nonwoven web into and through the through-fluid bonding oven intermediate the first and second porous members. The intermediate continuous fiber nonwoven web may be conveyed intermediate the first and second porous members at least partially using shear forces generated by the first and second porous members. The method may comprise reducing the machine direction strain of the intermediate continuous fiber nonwoven web owing to the shear force transport of the web. The machine direction strain may be less than 1.8%, or any other range specified herein. The first porous member may be positioned around first rollers, and the second porous member may be positioned around second rollers. The first porous member may be driven around the first rollers, and the second porous member may be driven around the second rollers.

The method may comprise flowing a first heated fluid through the first and second porous members within the through-fluid bonding oven in a first direction in a first zone of the through-fluid bonding oven. The method may comprise flowing a second heated fluid through the first and second porous members within the through-fluid bonding oven in a second, generally opposite direction in a second zone of the through-fluid bonding oven. The second zone may be downstream of the first zone. The first and second heated fluids may be in the range of about 10 degrees C. to about 280 degrees C. The method may comprise recirculating the first and second heated fluids. The first and second heated fluids may be recirculated within the through-fluid bonding oven or may be recirculated outside of the through-fluid bonding oven. The first and second heated fluids may or may not be heated during recirculation. The method may comprise cooling the intermediate continuous fiber nonwoven web after exposure to the first heated fluid and/or the second heated fluid.

The method may comprise using the first heated fluid to force a first surface of the intermediate continuous fiber nonwoven web in the first zone against the first porous member. The method may comprise using the second heated fluid to force a second surface of the intermediate continuous fiber nonwoven web in the second zone against the second porous member. The method may comprise creating a continuous fiber nonwoven web in the through-fluid bonding oven. The residence time of the intermediate continuous fiber nonwoven web within the through-fluid oven may be in the range of about 5 seconds and about 40 seconds, about 7 seconds to about 30 seconds, or about 10 seconds to about 25 seconds, for example.

The intermediate continuous fiber nonwoven web may comprise bi-component fibers comprising a first polymer component and a second polymer component. In an example, the bi-component fibers may comprise polypropylene and polyethylene. In another example, the bi-component fibers may comprise polyethylene and polyethylene terephthalate. In another example, the bi-component fibers may comprise a first polymer component and a second polymer component, wherein the melting temperature of the first polymer component may be different than the melting temperature of the second polymer component by at least 10 degrees C., but less than 180 degrees C. The fibers of the intermediate continuous fiber nonwoven web may comprise crimped fibers. The web may also have a denier less than 1.2 decitex. Smaller decitex fibers may be easier to through-fluid bond.

The method may comprise not calendar bonding the intermediate continuous fiber nonwoven web prior to conveying the web into the through-fluid bonding oven. The method may comprise intermittently pre-bonding the intermediate continuous fiber nonwoven web with a heated fluid prior to conveying the web into the through-fluid bonding oven. The method may also comprise re-entangling the intermediate continuous fiber nonwoven web prior to conveying the web into the through-fluid bonding oven.

A method of through-fluid bonding an intermediate continuous fiber nonwoven web is provided. The method may comprise providing a first through-fluid bonding oven. The first through-fluid bonding oven may comprise a first porous member and a second porous member. The method may comprise conveying the intermediate continuous fiber nonwoven web into and through the first through-fluid bonding oven intermediate the first porous member and the second porous member and flowing a first heated fluid through the first and second porous members within the first through-fluid bonding oven in a first direction. The method may comprise providing a second through-fluid bonding oven and conveying the intermediate continuous fiber nonwoven web into and through the second through-fluid bonding oven intermediate the first porous member and the second porous member. The method may comprise flowing a second heated fluid through the first and second porous members within the second through-fluid bonding oven in a second, generally opposite direction to the first direction. The second through-fluid bonding oven may be positioned downstream of the first through-fluid bonding oven. The method may comprise using the first heated fluid to force a first surface of the intermediate continuous fiber nonwoven web in the first through-fluid bonding oven against the first porous member and using the second heated fluid to force a second surface of the intermediate continuous fiber nonwoven web in the second through-fluid bonding oven against the second porous member to create a continuous fiber nonwoven web.

A method of through-fluid bonding an intermediate continuous fiber nonwoven web is provided. The method may comprise providing a first through-fluid bonding oven. The first through-fluid bonding oven may comprise a first porous member and a second porous member. The method may comprise conveying the intermediate continuous fiber nonwoven web into and through the first through-fluid bonding oven intermediate the first porous member and the second porous member and flowing a first heated fluid through the first and second porous members within the first through-fluid bonding oven in a first direction. The method may comprise providing a second through-fluid bonding oven and conveying the intermediate continuous fiber nonwoven web into and through the second through-fluid bonding oven intermediate a third porous member and the fourth porous member. The method may comprise flowing a second heated fluid through the third and fourth porous members within the second through-fluid bonding oven in a second, generally opposite direction to the first direction. The second through-fluid bonding oven may be positioned downstream of the first through-fluid bonding oven. The method may comprise using the first heated fluid to force a first surface of the intermediate continuous fiber nonwoven web in the first through-fluid bonding oven against the first porous member and using the second heated fluid to force a second surface of the intermediate continuous fiber nonwoven web in the second through-fluid bonding oven against the fourth porous member to create a continuous fiber nonwoven web.

Examples/Combinations

A. A method of through-fluid bonding an intermediate continuous fiber nonwoven web, the method comprising:

providing a through-fluid bonding oven;

the through-fluid bonding oven comprising a first porous member and a second porous member;

conveying the intermediate continuous fiber nonwoven web into and through the through-fluid bonding oven intermediate the first porous member and the second porous member;

flowing a first heated fluid through the first and second porous members within the through-fluid bonding oven in a first direction in a first zone of the through-fluid bonding oven;

flowing a second heated fluid through the first and second porous members within the through-fluid bonding oven in a second, generally opposite direction in a second zone of the through-fluid bonding oven, wherein the second zone is downstream of the first zone;

using the first heated fluid to force a first surface of the intermediate continuous fiber nonwoven web in the first zone against the first porous member; and using the second heated fluid to force a second surface of the intermediate continuous fiber nonwoven web in the second zone against the second porous member to create a continuous fiber nonwoven web, wherein the intermediate continuous fiber nonwoven comprises bi-component fibers comprising a first polymer component and a second polymer component, and wherein the first polymer component has a melting temperature that is different than the second polymer component by at least 10 degrees C., but less than 180 degrees C.

B. The method of Paragraph A, wherein the first polymer component comprises polypropylene and the second polymer component comprises polyethylene.

C. The method of Paragraph A, wherein the first polymer component comprises polyethylene and the second polymer component comprises polyethylene terephthalate.

D. The method of any one of Paragraphs A-C, wherein the first porous member is positioned around first rollers, and wherein the second porous member is positioned around second rollers, the method comprising:

driving the first porous member around the first rollers; and driving the second porous member around the second rollers.

E. The method of any one of Paragraphs A-D, comprising:

recirculating the first heated fluid; and recirculating the second heated fluid.

F. The method of any one of Paragraphs A-E, wherein the first heated fluid is in the range of about 10 degrees C. to about 280 degrees C.

G. The method of any one of Paragraphs A-F, wherein fibers of the intermediate continuous fiber nonwoven web comprise crimped fibers.

H. The method of any one of Paragraphs A-G, comprising reducing a machine direction strain of the intermediate continuous fiber nonwoven web intermediate the first porous member and the second porous member.

I. The method of Paragraph H, wherein the machine direction strain is less than 1.8%.

J. The method of Paragraph H, wherein the machine direction strain is negative.

K. The method of any one of Paragraphs A-J, comprising conveying the intermediate continuous fiber nonwoven web intermediate the first and second porous members at least partially using shear forces.

L. The method of any one of Paragraphs A-K, wherein the intermediate continuous fiber nonwoven web is not calendar bonded prior to being conveyed into the through-fluid bonding oven.

M. The method of any one of Paragraphs A-L, wherein the intermediate continuous fiber nonwoven web is intermittently pre-bonded with a heated fluid prior to being conveyed into the through-fluid bonding oven.

N. The method of any one of Paragraphs A-M, wherein the intermediate continuous fiber nonwoven web is entangled prior to being conveyed into the through-fluid bonding oven.

O. The method of any one of Paragraphs A-N, wherein continuous fibers of the continuous fiber nonwoven web have a denier less than 1.2 decitex.

P. The method of any one of Paragraphs A-O, comprising cooling the intermediate continuous fiber nonwoven web after exposure to the first heated fluid and/or the second heated fluid.

Q. A method of through-fluid bonding an intermediate continuous fiber nonwoven web, the method comprising:

providing a first through-fluid bonding oven;

the first through-fluid bonding oven comprising a first porous member and a second porous member;

conveying the intermediate continuous fiber nonwoven web into and through the first through-fluid bonding oven intermediate the first porous member and the second porous member;

flowing a first heated fluid through the first and second porous members within the first through-fluid bonding oven in a first direction;

providing a second through-fluid bonding oven;

conveying the intermediate continuous fiber nonwoven web into and through the second through-fluid bonding oven intermediate the first porous member and the second porous member;

flowing a second heated fluid through the first and second porous members within the second through-fluid bonding oven in a second, generally opposite direction to the first direction, wherein the second through-fluid bonding oven is downstream of the first through-fluid bonding oven;

using the first heated fluid to force a first surface of the intermediate continuous fiber nonwoven web in the first through-fluid bonding oven against the first porous member; and using the second heated fluid to force a second surface of the intermediate continuous fiber nonwoven web in the second through-fluid bonding oven against the second porous member to create a continuous fiber nonwoven web;

wherein the intermediate continuous fiber nonwoven comprises bi-component fibers comprising a first polymer component and a second polymer component, and wherein the first polymer component has a melting temperature that is different than the second polymer component by at least 10 degrees C., but less than 180 degrees C.

R. A method of through-fluid bonding an intermediate continuous fiber nonwoven web, the method comprising:

providing a first through-fluid bonding oven;

the first through-fluid bonding oven comprising a first porous member and a second porous member;

conveying the intermediate continuous fiber nonwoven web into and through the first through-fluid bonding oven intermediate the first porous member and the second porous member;

flowing a first heated fluid through the first and second porous members within the first through-fluid bonding oven in a first direction;

providing a second through-fluid bonding oven;

conveying the intermediate continuous fiber nonwoven web into and through the second through-fluid bonding oven intermediate a third porous member and a fourth porous member;

flowing a second heated fluid through the third and fourth porous members within the second through-fluid bonding oven in a second, generally opposite direction to the first direction, wherein the second through-fluid bonding oven is downstream of the first through-fluid bonding oven;

using the first heated fluid to force a first surface of the intermediate continuous fiber nonwoven web in the first through-fluid bonding oven against the first porous member; and using the second heated fluid to force a second surface of the intermediate continuous fiber nonwoven web in the second through-fluid bonding oven against the fourth porous member to create a continuous fiber nonwoven web;

wherein the intermediate continuous fiber nonwoven comprises bi-component fibers comprising a first polymer component and a second polymer component, and wherein the first polymer component has a melting temperature that is different than the second polymer component by at least 10 degrees C., but less than 180 degrees C.

S. The method of Paragraph R, comprising cooling the intermediate continuous fiber nonwoven web after exposure to the first and/or second heated fluids.

Figure 4:
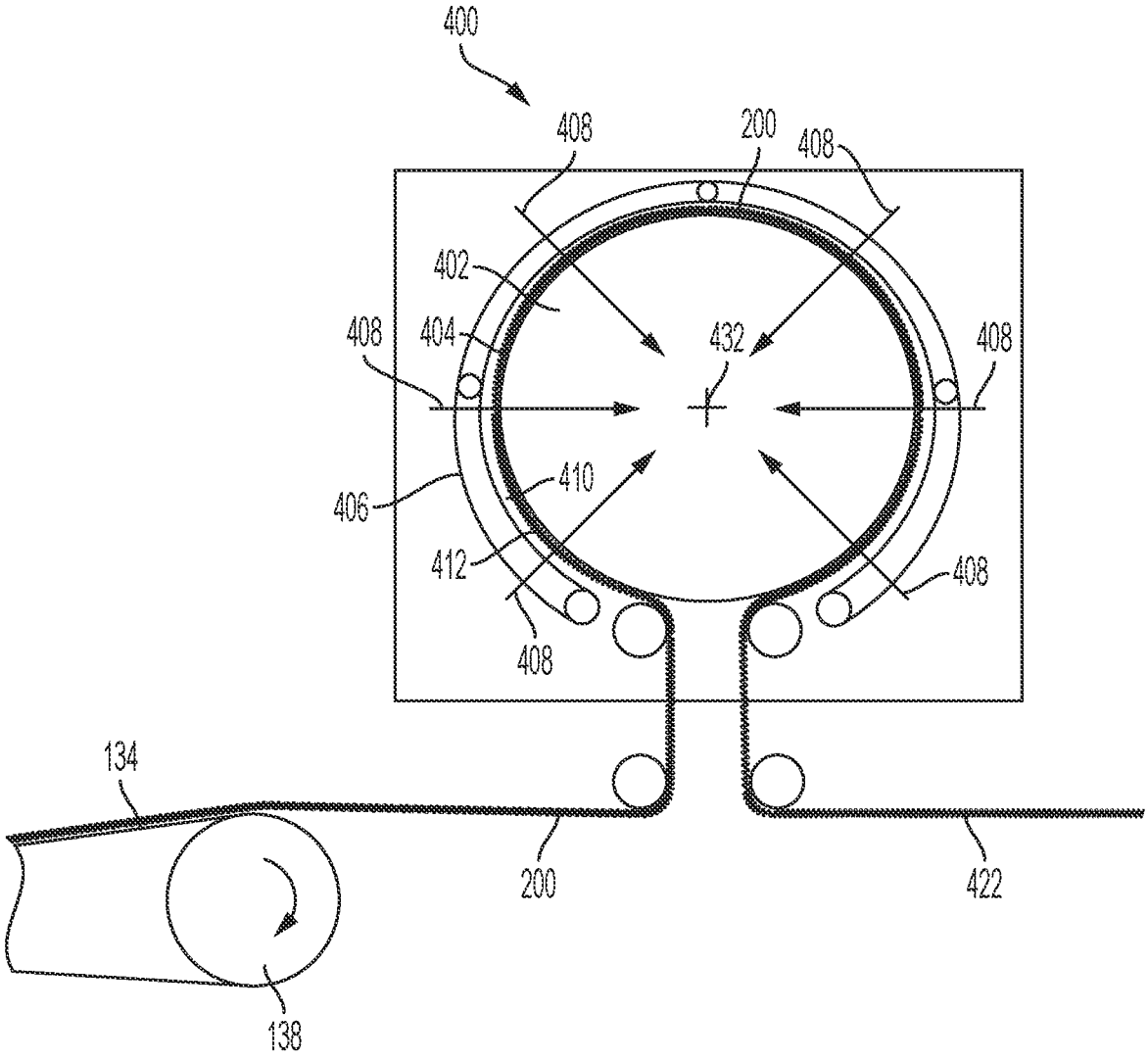
FIG. 4 is a diagrammatic view of a through-fluid bonding oven comprising a rotating porous member.

FIG. 4 is a schematic illustration of a through-fluid bonding oven 400 of the present disclosure. The intermediate continuous fiber nonwoven web 200 may be conveyed on the moving porous member 134, or on other belts or conveyors, into the through-fluid bonding oven. The web 200 may be intermittently pre-bonded with a heated fluid and/or re-entangled or reoriented prior to being conveyed into the through-fluid bonding oven 400. The web 200 may not be calendar bonded prior to being conveyed into the through-fluid bonding oven 400.

Referring to FIG. 4, the web 200 may be transferred from the moving porous member 134, or other conveyer or belt, onto a rotating porous member 402. A first surface 410 of the web 200 may be in face-to-face contact with the rotating porous member 402. The rotating porous member 402 may comprise a perforated drum, for example. The web 200 may be positioned intermediate a surface 404 of the rotating porous member 402 and a porous belt or conveyor 406. A second surface 412 of the web 200 may be in face-to-face contact with the porous belt or conveyor 406. The porous belt or conveyor 406 may also be positioned about 0.1 mm to about 50 mm, about 0.5 mm to about 50 mm, or about 1 mm to about 20 mm, away from the second surface 412 of the web 200. The web 200 may be conveyed intermediate the rotating porous member 402 and the porous belt 406 at least partially using shear forces. This allows the machine direction strain of the web to be relaxed. This also may reduce fiber blow-back. The web 200 may be conveyed on a belt or conveyor intermediate the moving porous member 134 and the rotating porous member 402. After rotating partially around the rotating porous member 402, the web 200 may be conveyed on a belt or conveyor intermediate the rotating porous member and a subsequent process step.

Figure 4A:
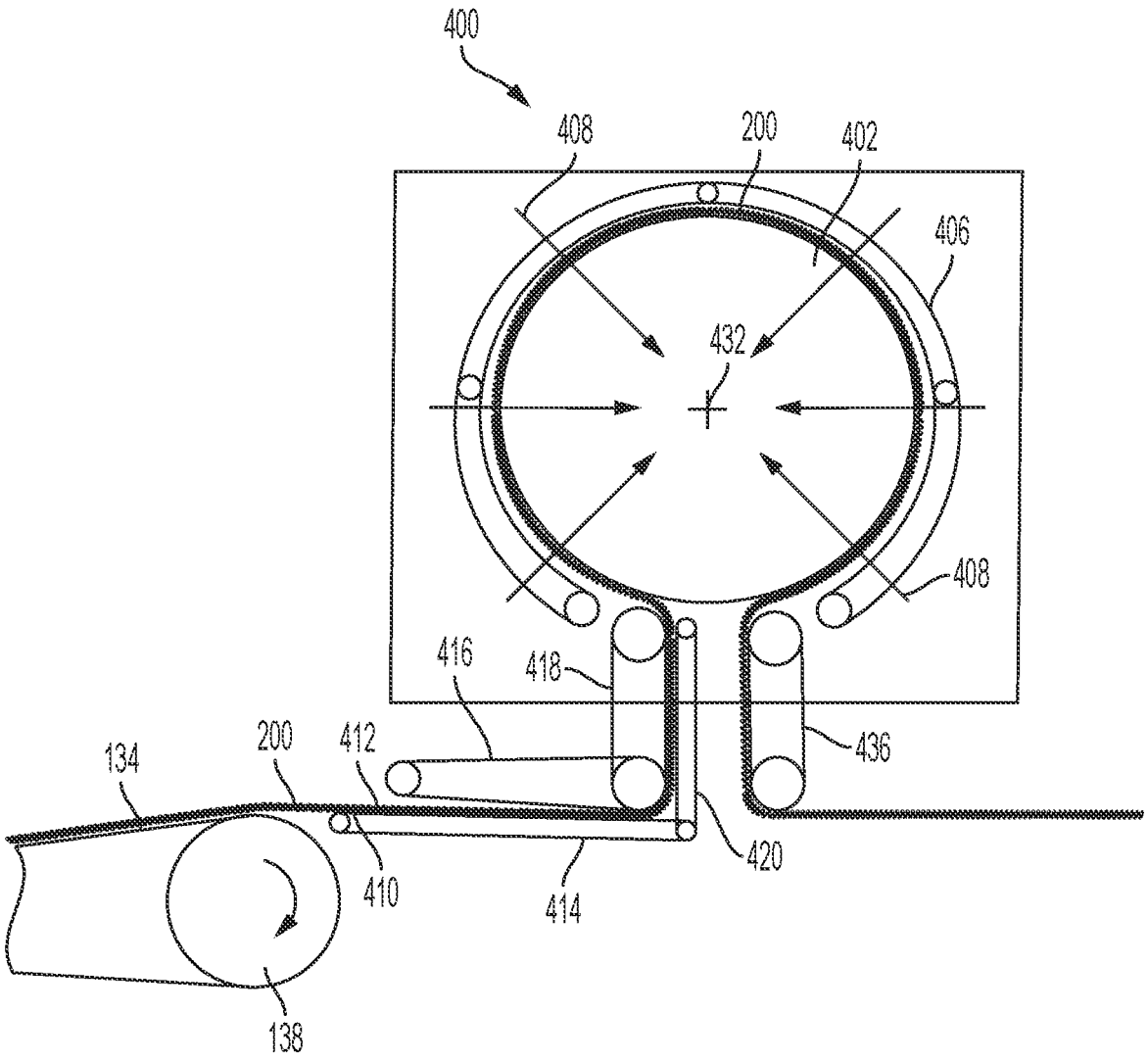
FIG. 4A is a diagrammatic view of a through-fluid bonding oven comprising a plurality of transfer members.

Referring now to FIG. 4A, the web 200 may be conveyed to the through-fluid bonding oven 400 intermediate a first transfer member 414 and a second transfer member 416. The first and second transfer members 414 and 416 may comprise belts or conveyors. At least a portion of, or all of, the first and second transfer members 414 and 416 may be positioned partially or completely outside of the through-fluid bonding oven 400. The first and second transfer members 414 and 416 may be porous or non-porous or may have porous or non-porous portions. The web 200 may be conveyed in face-to-face contact on the first surface 410 and second surface 412 with the first and second transfer members 414 and 416, respectively. The first and second transfer members 414 and 416 may also be positioned about 0.1 mm to about 50 mm, about 0.5 mm to about 50 mm, or about 1 mm to about 20 mm, away from the first surface 410 and the second surface 412 of the web 200.

Referring again to FIG. 4A, the web 200 may be conveyed into the through-fluid bonding oven 400 intermediate a third transfer member 418 and a fourth transfer member 420. The third and fourth transfer members 418 and 420 may comprise belts, for example. At least a portion of, or all of, the third and fourth transfer members 418 and 420 may be positioned within or outside of the through-fluid bonding oven 400. The third and fourth transfer members 418 and 420 may be porous or non-porous or may have porous or non-porous portions. The web 200 may be conveyed in face-to-face contact on the first surface 410 and second surface 412 with the third and fourth transfer members 418 and 420, respectively. The third and fourth transfer members 418 and 420 may also be positioned about 0.1 mm to about 50 mm, about 0.5 mm to about 50 mm, or about 1 mm to about 20 mm, away from the first surface 410 and the second surface 412 of the web 200. The web 200 may be conveyed on a fifth transfer 430 member when exiting the through-fluid bonding oven 400.

Without wishing to be bound by theory, it is hypothesized that the "sandwiched" arrangement of the rotating porous member 402 and the porous belt or conveyor 406, the first and second transfer member 414 and 416, and the third and fourth transfer member 418 and 420, allows the web 200 to be transferred by shear forces. This consequently allows the machine direction strain to be reduced, even to a negative machine direction strain. When the web 200 transport through a portion of the oven 400 is assisted by shear, the machine direction tension may be in the range of about −15% to about 5%, about −10% to about 5%, about −5% to about 5%, about −2% to about 5%, about −2% to about 3%, about −2% to about 1.8%, about −2% to about 1.5%, or about −2% to about 0.5%, for example. Machine direction strain may be defined as the ((present length of the web minus original length of the web at entry of the device where the web transport is assisted by shear)/original length of the web)×100%. Additionally, the "sandwiched" arrangement of the rotating porous member 402 and the porous belt or conveyor 406 helps in preventing, or at least inhibiting, fiber blow-back and providing the web 200 with some structural integrity. The porous member 406 and the first to fourth transfer members 414, 416, 418, and 420 may also maintain the web so that it may be through-fluid bonded without fiber blow-back.

Referring again to FIG. 4, a heated fluid 408, such as hot air, may be flowed through the porous belt 406, through the web 200, and then flowed through the rotating porous member 402 within the through-fluid bonding oven 400. The heated fluid 408 may be flowed through the porous belt 406, the web 200, and rotating porous member 402 in a direction toward a rotational axis 432 of the rotating porous member 402. The heated fluid 408 may be heated to a range of 10 degrees C. to about 280 degrees C., for example. The heated fluid 408 may flow through the through-fluid bonding oven 400 at a flow rate in the range of about 5 m/s to about 0.5 m/s. The heated fluid 408 may be recirculated within the through-fluid bonding oven 400 or may be recirculated outside of the through-fluid bonding oven 400. The heated fluid 408 may or may not receive additional heat during the recirculation step. Alternatively, the heated fluid 408 may not be recirculated. In some instances, it may be desirable to cool the web 200 within or immediately outside the through-fluid bonding oven 400 to set the fiber-to-fiber bonding.

The first surface 410 of the web 200 may be bonded using the rotating porous member 402 as the first surface 410 is in contact with the rotating porous member 402. Bonding of the first surface 410 using the rotating porous member 402 may be accomplished through conductive heat transfer from the rotating porous member 402 to the first surface 410. Bonding of the second surface 412 facing away from the rotating porous member 402 may be accomplished by convective heat transfer, if the porous belt or conveyor 406 is not provided or if the porous belt or conveyor 406 is a positioned a distance away from the web 200. Conductive heating, by allowing the surface of a web to contact a heated porous belt, tends to be more efficient at achieving surface bonding as compared to convective heating, especially with regard to porous, low basis weight nonwoven webs. Velocity of the heated fluid 408 through the bonding oven 400 may be adjusted to control the contact pressure between the nonwoven web 200 and the rotating porous member 406. It may be desired not to exert high air pressure that may damage the lofty structure of the nonwoven web 200. Velocity of the heated fluid 408 may be more than 0.5 m/s for sufficient contact between web and the rotating porous member 406. Velocity of the heated fluid 408 of less than 5 m/s may prevent, or at least inhibit, loss of loft in the web 200. Velocity of the heated fluid 408 through the through-fluid bonding oven 400 may be in a range of about 0.5 m/s to about 5 m/s, about 0.5 m/s to about 2.5 m/s, about 0.5 m/s to about 2 m/s, or about 0.5 m/s to about 1.5 m/s, for example. It may also be desired that the web 200 resides within the through-fluid bonding oven 400 for a period of time between about 5 seconds and about 45 seconds, between about 7 seconds and about 30 seconds, or between about 10 seconds and about 25 seconds, for example. A residence time in the oven in these ranges may allow the web 200 to achieve optimal loft and bonding sufficiency.

The second surface 412 of the web 200 may be bonded using the porous belt 406 if the second surface 412 is in contact with the porous belt 406. Bonding of the second surface 412 using the porous belt 406 may be accomplished through conductive heat transfer from the porous belt 406 to the second surface 412. Sidedness of bonding of the web may be reduced by simultaneously forcing the first surface 410 and the second surface 412 of the web 200 into contact with the rotating porous member 402 and the porous belt 406 so that both sides receive substantially similar conductive heat transfer within the through-fluid bonding oven 400. Bonding of the first surface 410 and the second surface 412 of the intermediate continuous fiber nonwoven web 200 as described above may result in a continuous fiber nonwoven web 422 that has increased loft and softness with reduced sidedness and suitable structural integrity.

Methods/Examples

A method of through-fluid bonding an intermediate continuous fiber nonwoven web is provided. The method may comprise providing a through-fluid bonding oven comprising a rotating porous member and a porous belt. The rotating porous member may comprise a perforated drum. The method may comprise conveying the intermediate continuous fiber nonwoven web into and through the through-fluid bonding oven intermediate a surface of the rotating porous member and the porous belt. The intermediate continuous fiber nonwoven web may be conveyed intermediate the first and second porous members at least partially using shear forces. The method may comprise reducing the machine direction strain of the intermediate continuous fiber nonwoven web owing to the shear forces. The machine direction strain may be less than 1.8%, or any other range specified herein.

The method may comprise flowing a heated fluid through the porous belt, the intermediate continuous fiber nonwoven web, and the rotating porous member. The heated fluid may be in the range of about 10 degrees C. to about 280 degrees C. The method may comprise recirculating the heated fluid. The heated fluid may be recirculated within the through-fluid bonding oven or may be recirculated outside of the through-fluid bonding oven. The heated fluid may be heated during recirculation. The method may comprise cooling the intermediate continuous fiber nonwoven web after or during the flowing a heated fluid step.

The method may comprise using the heated fluid, the porous belt, and the rotating porous member to bond a first surface and a second surface of the intermediate continuous fiber nonwoven web. The method may comprise using the heated fluid to force the first surface of the intermediate continuous fiber nonwoven web against the surface of the rotating porous member. The first surface may be bonded via conductive heat transfer from the surface of the rotating porous member. The method may comprise using the porous belt to bond the second surface of the intermediate continuous fiber nonwoven web. The second surface may be bonded by conductive heat transfer from the surface of the porous belt. The second surface may be bonded by convective heat transfer from the heated fluid if the second surface is not in contact with the porous belt or conveyor. The method may comprise creating a continuous fiber nonwoven web in the through-fluid bonding oven. The residence time of the intermediate continuous fiber nonwoven web within the through-fluid oven may be in the range of about 5 seconds and about 40 seconds, about 7 seconds to about 30 seconds, or about 10 seconds to about 25 seconds, for example.

The intermediate continuous fiber nonwoven web may comprise bi-component fibers comprising a first polymer component and a second polymer component. In an example, the bi-component fibers may comprise polypropylene and polyethylene. In another example, the bi-component fibers may comprise polyethylene and polyethylene terephthalate. In another example, the bi-component fibers may comprise a first polymer component and a second polymer component, and the melting temperature of the first polymer component is different than the melting temperature of the second polymer component by at least 10 degrees C., but less than 180 degrees C. (or other ranges specified herein). The fibers of the intermediate continuous fiber nonwoven web may comprise crimped fibers. The web may also have a denier less than 1.2 decitex. Smaller decitex fibers may be easier to through-fluid bond.

The method may comprise not calendar bonding the intermediate continuous fiber nonwoven web prior to conveying the web into the through-fluid bonding oven. The method may comprise intermittently pre-bonding the intermediate continuous fiber nonwoven web with a heated fluid prior to conveying the web into the through-fluid bonding oven. The method may comprise re-entangling the intermediate continuous fiber nonwoven web prior to conveying the web into the through-fluid bonding oven.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any embodiment disclosed or claimed herein or that it alone, or in any combination with any other reference or references, teaches, suggests or discloses any such embodiment. Further, to the extent that any meaning or definition of a term in this document conflicts with any meaning or definition of the same term in a document incorporated by reference, the meaning or definition assigned to that term in this document shall govern.

While particular embodiments of the present disclosure have been illustrated and described, it would be obvious to those skilled in the art that various other changes and modifications may be made without departing from the spirit and scope of the present disclosure. It is therefore intended to cover in the appended claims all such changes and modifications that are within the scope of this disclosure.

What is claimed is:

1. A method of through-fluid bonding an intermediate continuous fiber nonwoven web, the method comprising:

providing a through-fluid bonding oven, the through-fluid bonding oven comprising a first rotating porous member and a second rotating porous member, wherein the second rotating porous member is disposed below the first rotating porous member;

conveying the intermediate continuous fiber nonwoven web through the through-fluid bonding oven and onto the first rotating porous member; wherein the intermediate continuous fiber nonwoven web comprises a first surface and a second, opposing surface; wherein the first surface of the intermediate continuous fiber nonwoven web is in face-to-face contact with the first rotating porous member; and wherein the second surface of the intermediate continuous fiber nonwoven web faces away from the first rotating porous member;

transferring the intermediate continuous fiber nonwoven web from the first rotating porous member to the second rotating porous member, such that the second surface of the intermediate continuous fiber nonwoven web is in face-to-face contact with the second rotating porous member, and the first surface of the intermediate continuous fiber nonwoven web faces away from the second rotating porous member;

flowing a heated fluid through the through-fluid bonding oven such that the heated fluid flows in a first direction through the first rotating porous member, the second rotating porous member, and the intermediate continuous fiber nonwoven web;

using the heated fluid, the first rotating porous member, and the second rotating porous member to bond the first surface and the second surface of the intermediate continuous fiber nonwoven web;

wherein the through-fluid bonding oven further comprises a third rotating porous member disposed in a face-to-face relationship with the second surface of the intermediate continuous fiber nonwoven web, such that in a portion of the through-fluid bonding oven the intermediate continuous fiber nonwoven web is disposed between the first rotating porous member and the third rotating porous member; and wherein the intermediate continuous fiber nonwoven comprises bi-component fibers comprising a first polymer component and a second polymer component, and wherein the first polymer component has a melting temperature that is different than the second polymer component by at least 10 degrees C., but less than 180 degrees C.

2. The method of claim 1, wherein the first polymer component comprises polypropylene and the second polymer component comprises polyethylene.

3. The method of claim 1, wherein the first polymer component comprises polyethylene and the second polymer component comprises polyethylene terephthalate.

4. The method of claim 1, wherein fibers of the intermediate continuous fiber nonwoven web comprise crimped fibers.

5. The method of claim 1, wherein the heated fluid is in the range of about 10 degrees C. to about 280 degrees C.

6. The method of claim 1, wherein the intermediate continuous fiber nonwoven web between the first rotating porous member and the second rotating porous member has a machine direction strain, and wherein the machine direction strain is less than 1.8%.

7. The method of claim 1, wherein the intermediate continuous fiber nonwoven web between the first rotating porous member and the second rotating porous member has a machine direction strain, and wherein the machine direction strain is negative.

8. The method of claim 1, wherein the intermediate continuous fiber nonwoven web is not calendar bonded prior to being conveyed into the through-fluid bonding oven.

9. The method of claim 1, further comprising intermittently pre-bonding the intermediate continuous fiber nonwoven web with a heated fluid prior to being conveyed into the through-fluid bonding oven.

10. The method of claim 1, further comprising re-entangling the intermediate continuous fiber nonwoven web prior to being conveyed into the through-fluid bonding oven.

11. The method of claim 1, wherein continuous fibers of the intermediate continuous fiber nonwoven web have a denier less than 1.2 decitex.

12. The method of claim 1, comprising cooling the intermediate continuous fiber nonwoven web after or during the flowing a heated fluid step.

13. The method of claim 1, wherein the first rotating porous member conveys the intermediate continuous fiber nonwoven web in a first conveying direction, and wherein the second rotating porous member conveys the intermediate continuous fiber nonwoven web in a second, different conveying direction.

14. The method of claim 1, wherein the third rotating porous member is disposed between about 0.1 mm to about 50 mm away from the second surface of the intermediate continuous fiber nonwoven web.

* * * * *